US005713395A

United States Patent [19]

Jakšič

[11] Patent Number: 5,713,395

[45] Date of Patent: Feb. 3, 1998

[54] ROTARY CAGE WHICH APPLIES WARP REELS IN A TRIAXIAL WEAVING MACHINE

[76] Inventor: Danilo Jakšič, Poljanski nasip 30, Ljubljana, Slovenia, 1000

[21] Appl. No.: 624,750

[22] Filed: Mar. 27, 1996

[30] Foreign Application Priority Data

Apr. 7, 1995 [SI] Slovenia ..... P9500115
Jan. 15, 1996 [SI] Slovenia ..... P9600010

[51] Int. Cl.[6] ..... D03D 41/00

[52] U.S. Cl. ..... 139/11

[58] Field of Search ..... 139/460, 28, 11, 139/458, 18, 457, 79

[56] References Cited

U.S. PATENT DOCUMENTS

| | | | |
|---|---|---|---|
| 3,998,250 | 12/1976 | Townsend . | |
| 4,006,759 | 2/1977 | Darsie . | |
| 4,022,250 | 5/1977 | Trost . | |
| 4,022,253 | 5/1977 | Trost . | |
| 4,031,922 | 6/1977 | Trost et al. . | |
| 4,036,262 | 7/1977 | Darsie et al. . | |
| 4,040,451 | 8/1977 | Trost et al. . | |
| 4,066,104 | 1/1978 | Halton et al. . | |
| 4,105,052 | 8/1978 | Trost et al. . | |
| 4,170,249 | 10/1979 | Trost | 139/11 |
| 4,484,603 | 11/1984 | Steiner . | |
| 4,512,373 | 4/1985 | Trost . | |
| 5,351,722 | 10/1994 | Mamiliano | 139/11 |
| 5,375,627 | 12/1994 | Iida et al. . | |
| 5,511,588 | 4/1996 | Jaksic | 139/455 |

FOREIGN PATENT DOCUMENTS

| | | |
|---|---|---|
| 0087513 | 12/1982 | European Pat. Off. . |
| 2290518 | 11/1975 | France . |
| 2344658 | 3/1976 | France . |
| 26 34 966 | 2/1977 | Germany . |
| 26 45 369 | 4/1977 | Germany . |
| 612223 | 7/1979 | Switzerland . |
| 617 232 | 5/1980 | Switzerland . |
| 1460531 | 1/1974 | United Kingdom . |
| 1 532 426 | 11/1978 | United Kingdom . |
| 1 570 456 | 7/1980 | United Kingdom . |
| 2115021 | 9/1983 | United Kingdom . |

OTHER PUBLICATIONS

"Triaxial weaving" Barber–Colman Company Textile Machinery Division (undated).

*Primary Examiner*—Andy Falik
*Attorney, Agent, or Firm*—Jacobson, Price, Holman & Stern, PLLC

[57] ABSTRACT

In a rotary cage which applies warp spools, in atriaxial weaving machine, the spools are driven to unroll their yarns and for compensating for the length differences between the lengths of warp yarns delivered and the ones entrained. The warp spools are arranged in two levels. In a stationary device the warp yarns are rearranged from a preceding circular distribution to a subsequent planar two-plane distribution thereof. The device includes two intake rollers and two lateral shutter masks. In an assembly, a warp-yarn Z-system and a warp-yarn S-system are created. The assembly includes two spirally wound shafts. A shed-forming assembly includes a cam spindle incorporated under a respective spirally wound shaft. A weft laying-in and beating-up, respectively, attachment includes a weft shaft. Alternatively, a shed-forming weft-laying-in and weft-beating-up, respectively, weft shaft is incorporated under a spirally wound shaft.

18 Claims, 23 Drawing Sheets

ROTARY CAGE WHICH APPLIES WARP REELS IN A TRIAXIAL WEAVING MACHINE

FIELD OF THE INVENTION

This invention relates to triaxial weaving machines comprising an upright framing which at the top supports a rotary cage for applying warp reels and driving them to unroll their yarns and for compensating the length differences between the lengths of warp yarns delivered and the ones entrained, a stationary device positioned underneath for rearranging the warp yarns from a preceding circular distribution to a subsequent planar two-plane distribution thereof, an assembly positioned underneath for creating a warp-yarn Z-system and a warp-yarn S-system, respectively, a shed-forming and weft laying-in attachment positioned underneath, and, finally, a section of the machine accommodating the triaxially woven fabric.

BACKGROUND OF THE INVENTION

The following prior art references where considered when creating the captioned invention. References in bold type have been considered particularly relevant if taken alone.

U.S. Pat. Nos. 3,998,250 Townsend, 4,006,759 Darsie, 4,022,250 Trost, 4,022253 Trost, 4,031,922 Trost, 4,040,451 Trost et al., 4,105,052 Trost et al., and 4,512,373 Trost;

CH612,223 (≡DE2,634,966) Kulczycki, and 617,232 (≡GB1,532,426) Halton et al.;

DE2,645,369 Townsend;

GB1,570,456 Kulczycki, and 2,115,021 (shed-forming apparatus).

A"Triaxial Weaving" prospectus (particularly relevant): Prospectus No. F-16645; TW2000 Triaxial Weaving Machine produced by Barber-Colman Company, Textile Machinery Division (Address: 1300 Rock Street, Rockford, Ill. U.S.A., 61101).

The known machines are packed with oscillating elements. This fact per se represents a serious manufacturing limitation of the machine. For laying in a weft, rapier-type attachments are used which in this special field are known to be the slowest devices.

In the shed forming area warp yarns are conducted through and shifted to and fro, respectively (creating a Z-system and an S-system of the warp, respectively), according to a program by heddles, i.e. elements similar to platines. It is an enormous job to thread the heddles when creating a warp, and it is hardly possible to detect the respective heddle which got unthreaded in the course of weaving because the heddles move and therefore continuously change their position.

A mechanism for spontaneous compensating the length differences of the warp yarns is arranged in the middle of a warp-reel collar. It is extremely inconvenient to draw in the yarns (from the outer side of the warp-reel collar to the inside thereof and downwards) when preparing a warp, and it is especially complicated to draw in a broken yarn.

Owing to the division of the quantity of warp yarns in the weaving preparation to quite a great number of warp reels (eight in the prior an), the weaving preparations for a triaxial weaving machine essentially differ from those for biaxial ones. When a triaxial weaving machine is introduced into a weaving room furnished for manufacturing biaxial woven fabrics, it occupies quite a large amount of additional space and staff has to be additionally trained.

SUMMARY OF THE INVENTION

It is a basic object of the present invention to increase the manufacturing capacity of a triaxial weaving machine to a level that could make use of modem high-capacity weft laying-in attachments avoiding any big differences between operating a triaxial weaving machine and a biaxial one.

The object of the invention is achieved by a rotary cage arranged above for applying warp reels and driving them to unroll their yarns and for compensating for the length differences between the lengths of warp yarns delivered and the ones entrained, with the warp reels being arranged in two levels, further by a stationary device positioned underneath for rearranging the warp yarns from a preceding circular distribution to a subsequent planar two-plane distribution thereof, with the device being composed of two intake rollers and two lateral shutters arranged below, further by an assembly positioned underneath for creating a warp-yarn Z-system and a warp-yarn S-system, respectively, and composed of two spirally wound shafts, further by a shed-forming assembly positioned below and composed of a cam spindle incorporated under a respective spirally wound shaft, and by a weft laying-in and beating-up attachment positioned underneath and consisting of a weft shaft.

Alternatively, the object of the invention is achieved by a rotary cage arranged above for applying warp reels and driving them to unroll their yarns and for compensating for the length differences between the lengths of warp yarns delivered and the ones entrained, with the warp reels being arranged in two levels, further by a stationary device positioned underneath for rearranging the warp yarns from a preceding circular distribution to a subsequent planar two-plane distribution thereof, with the device being composed of two intake rollers and two lateral shutters arranged below, further by an assembly positioned underneath for creating a warp-yarn Z-system and a warp-yarn S-system, respectively, and composed of two spirally wound shafts, and by a shed-forming weft-laying-in and weft-beating-up weft shaft positioned below under a respective spirally wound shaft.

According to the invention, all main elements of the proposed machine without exception are rotational, which fact by itself results in a possible increase of the manufacturing capacity of the machine. By the warp reels being arranged in two levels it is possible, in comparison to the prior art, to increase the extent of the warp reels and the total mass of the warp.

Besides, according to the invention, in either level of warp reels in the rotary cage, there is foreseen a pair of trusses traversing the respective two warp reels and supporting guiding bars, suitably three per spool, and short-circuit (disconnection) bars, two per reel, with the warp yarns being led from each warp reel at the inner side of the machine upwards around the inner guiding bar belonging to the respective three-bar group, then reoriented to the outer side of the machine and led over the two disconnecting bars and the middle bar of the guiding-bar group and, finally, around the outer guiding bar of the three-bar group downwards by the outer side of the respective reel.

Thus the warp yarns are led near the outer border of the machine, which makes them easily surveyable and accessible.

Below the lower warp-reel level the cage of the machine provides fibbed arcuate rods, suitably four 90-grade rods, one per each reel, with two opposing rods of the said four rods positioned in an appropriate horizontal plane and the other two opposing rods positioned in another horizontal plane (for mounting reasons), with the warp yarns being led from above downwards by the outer mantle surface of the arcuate rods.

The spirally wound shaft according to the invention for shifting the warp yarns of the warp-yarn Z-system and the warp-yarn S-system, respectively, along the path of the weft suitably comprises four ridges with each of them terminating, at the end where a warp yarn leaves the warp-yarn Z/S-system and enters the warp-yarn S/Z-system, by a pusher for assisting the transfer of the yarns from one warp-yarn system to the other one.

The invention foresees two embodiments of spirally wound shafts, one of them providing zigzag-shaped ridges and the other one providing smooth (continuous) ridges.

The cam spindle of the invention consists of a plurality of radially emphasized annular discs and a plurality of radially emphasized annular cam-shaped spacers, the discs and the spacers being arranged alternatingly, with the thickness of the discs being negligibly small and the peripheral contour of the discs being square with rounded corners, the discs being incorporated to form an assembly so that they are uniformly oriented with their rounded corners residing in flush with the generatrices of the spindle, whereas the spacers are basically circular elements, whose outer diameter equals the sides of the square of the discs, and one, two, or three cams being formed integrally with them, the cam(s) each being oriented to the respective corner(s) of the square of the discs.

The weft shaft of the invention consists of a plurality of radially emphasized annular discs and a plurality of annular spacers, the discs and the spacers being arranged alternatingly, with the thickness of the discs being negligibly small and the discs each being basically an annular element, whose outer diameter equals that of the spacers, and comprising prongs which each consists of three sections, namely a radial section connected to the basic ring of the disc, a tangential section connected, by one of its ends, to the radial section, and a further radial section formed integrally with another end of the tangential section and oriented to the axis of the disc, so that the three sections of the prong create a cavity, whose bottom resides in the plane of the weft shaft, which includes the axis of the weft shaft.

It is a further feature of the prong that the outer edge of the tangential section of the prong is formed smoothly arcuately, which makes it possible to beat up the weft lying underneath to the woven fabric.

Alternatively, the weft shaft of the invention consists of a plurality of radially emphasized annular discs and a plurality of cam spacers, the discs and the spacers being arranged alternatingly, with the thickness of the discs being negligibly small and the discs each being basically an annular element, whose outer diameter equals that of an annular base of the cam spacers, and comprising prongs which each consists of three sections, namely a radial section connected to the basic ring of the disc, a tangential section connected, by one of its ends, to the radial section, and a further radial section formed integrally with another end of the tangential section and oriented to the axis of the disc, so that the three sections of the prong create a cavity, whose bottom resides in the plane of the weft shaft, which includes the axis of the weft shaft.

The cam of the cam spacer is positioned so that its radial edge being a rear edge with respect to the rotation flush with the bottom of the said cavity, and the outer edge of the tangential section of the prong is formed smoothly arcuately, which makes it possible to beat up the weft lying underneath to the woven fabric.

BRIEF DESCRIPTION OF THE DRAWINGS

Hereinafter, the invention is disclosed in detail on the basis of an embodiment of a triaxial weaving machine shown in the attached drawings.

In the drawings.

DETAIL DESCRIPTION OF THE PREFERRED EMBODIMENTS

Figure 1:
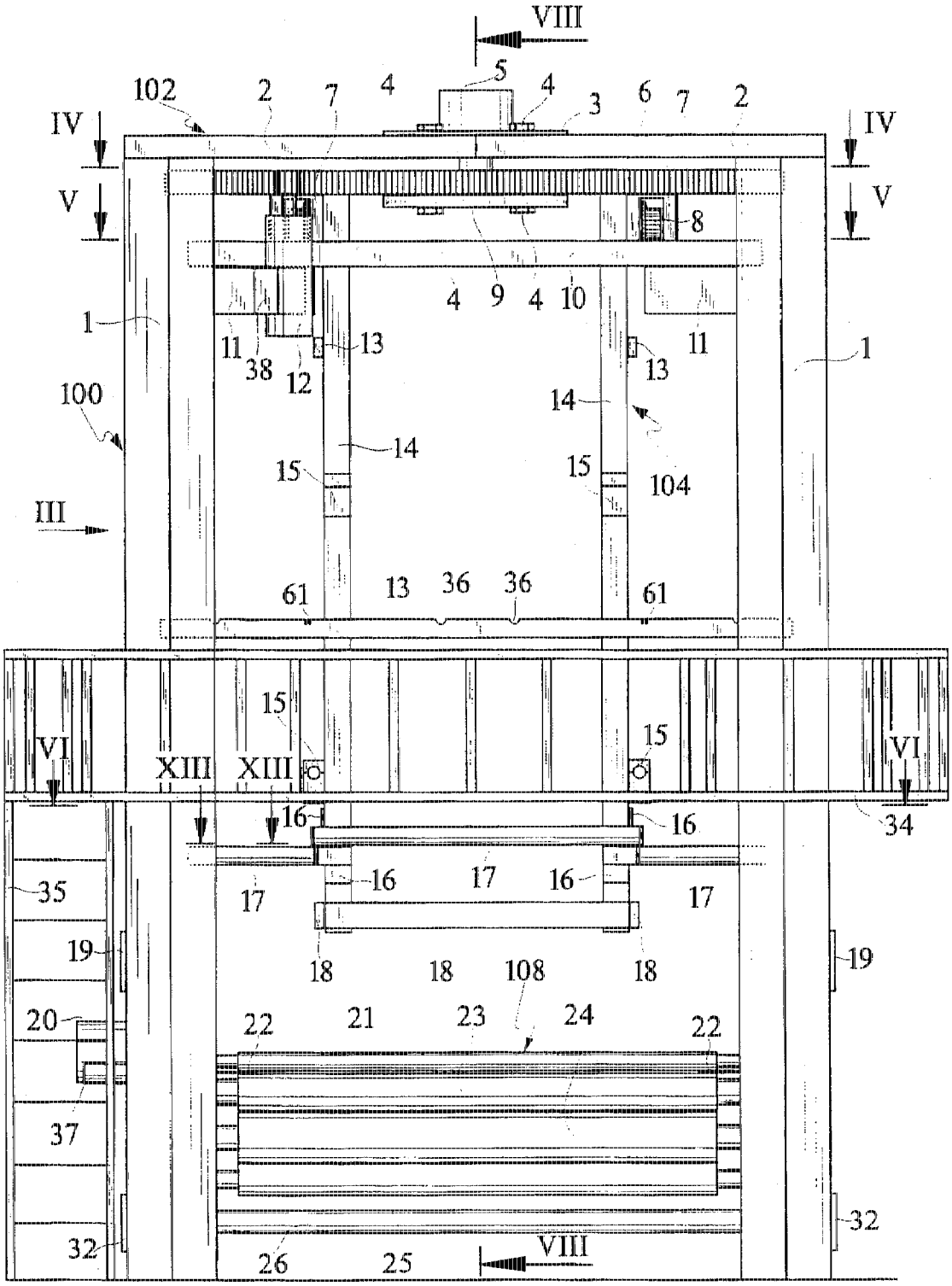
FIG. 1 is an elevational view of the front side of a machine prepared to apply warp reels and to arrange the warp, with the actually existing weft laying-in attachments being omitted from the drawing.
Figure 2:
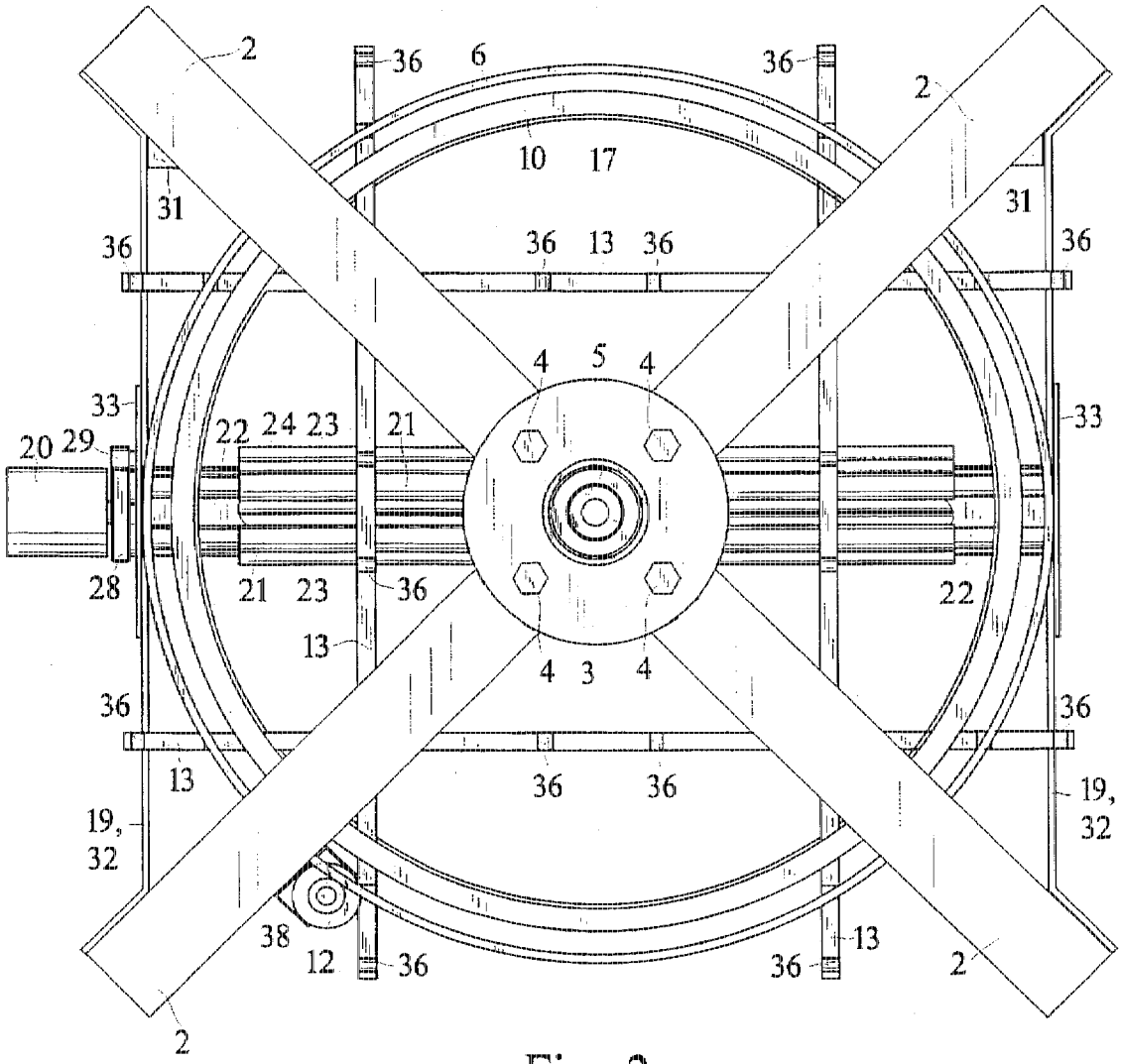
FIG. 2 is a plan view to FIG. 1 with scaffolding and access stairs omitted from the drawing.

The proposed machine is designed by starting from a stationary framework 100. It consists of four uprights 1 positioned on corners of a square field and interconnected at the top by a top cross 102 composed of interconnecting legs 2 residing over the diagonals of the square field. Onto the legs 2 a flange collar 3 of a housing of a deep-groove-type radial ball bearing 5 or the like is fastened by screws 4 from above in the middle of their junction.

Figure 5:
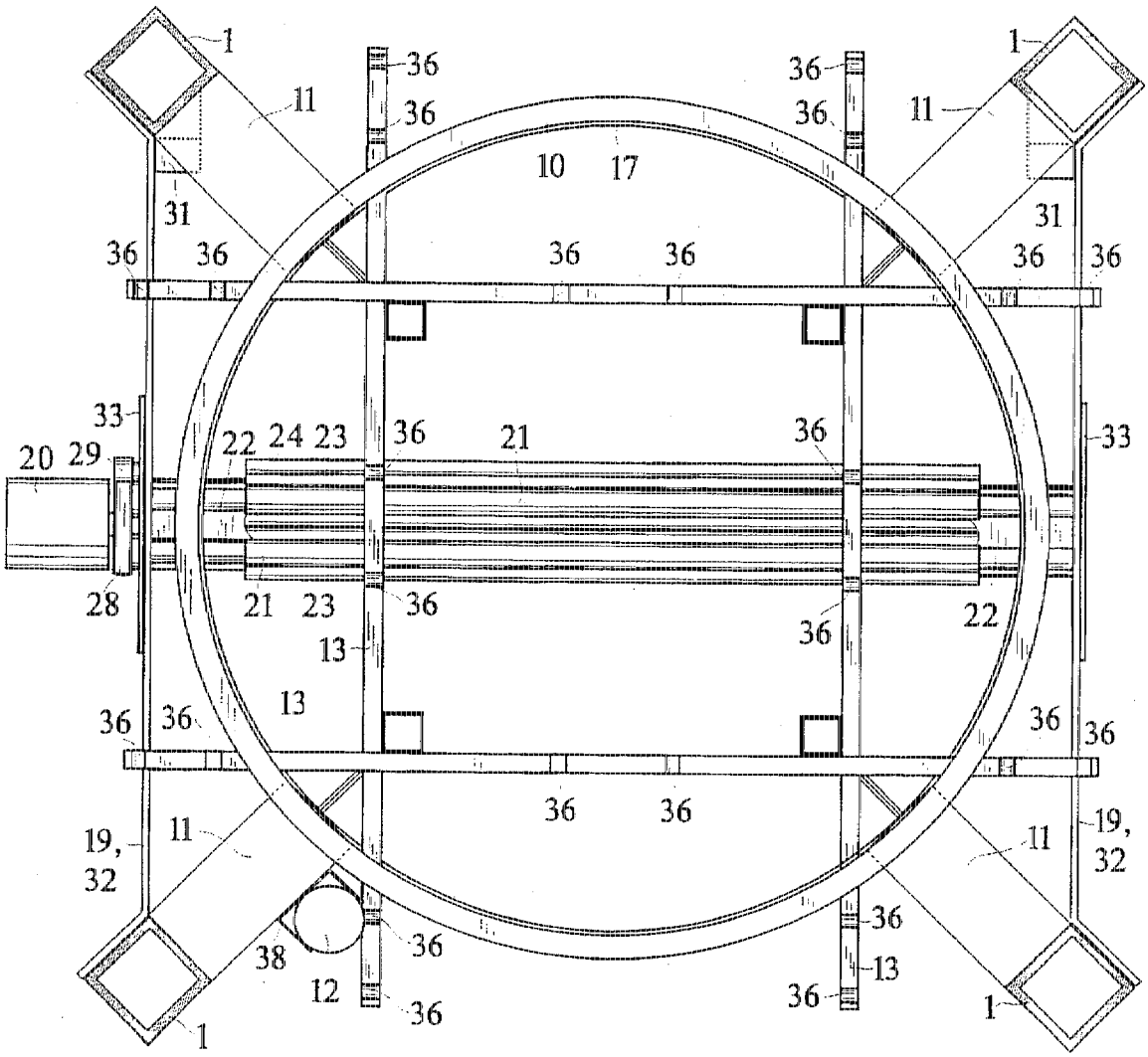
FIG. 5 is a sectional view taken according to the section line V—V in FIG. 1.

Each upright 1 provides an inwardly projected cantilever beam 11 (see FIG. 5) superposed by a respective leg 2 and spaced from the latter. An annular rail 10 is placed on the free ends of the cantilever beams 11 and appropriately fixed. One of four sides of the base of the framework of the machine is chosen to be the front side (the weaver's working place), the opposite side is thus the rear side of the machine (a cloth beam resides there) and the two remaining sides are lateral sides.

On the lateral sides of the framework of the machine, an upper traverse 19 and a lower traverse 32 are fixed on the pertaining two uprights 1 of each lateral side. A vertical bearing plate 33 for supporting a weaving assembly of the machine is fastened on each pair of the traverses 19 and 32 on their outer side, suitably in the middle between the uprights 1.

To the stationary part of the machine there also belongs a respective mechanical outfit such as bearings 31 of the cloth beam, a support 37 for an electromotor 20 for propelling the weaving assembly, a support 38 for an electromotor 12 for rotating the rotary cage provided with warp reels etc.

Finally, to the framework of the machine there also belongs a scaffold 34 which surrounds it and is provided with a respective guardrail and appropriate access steps 35.

A rotary cage 104 for receiving the warp reels is incorporated into the framework 100 of the machine by means of the adjustably incorporated top bearing 5, whereby the cage 104 is essentially retained in the radial direction, and by means of the annular rail 10, whereby the cage 104 is supported in vertical direction.

Figure 4:
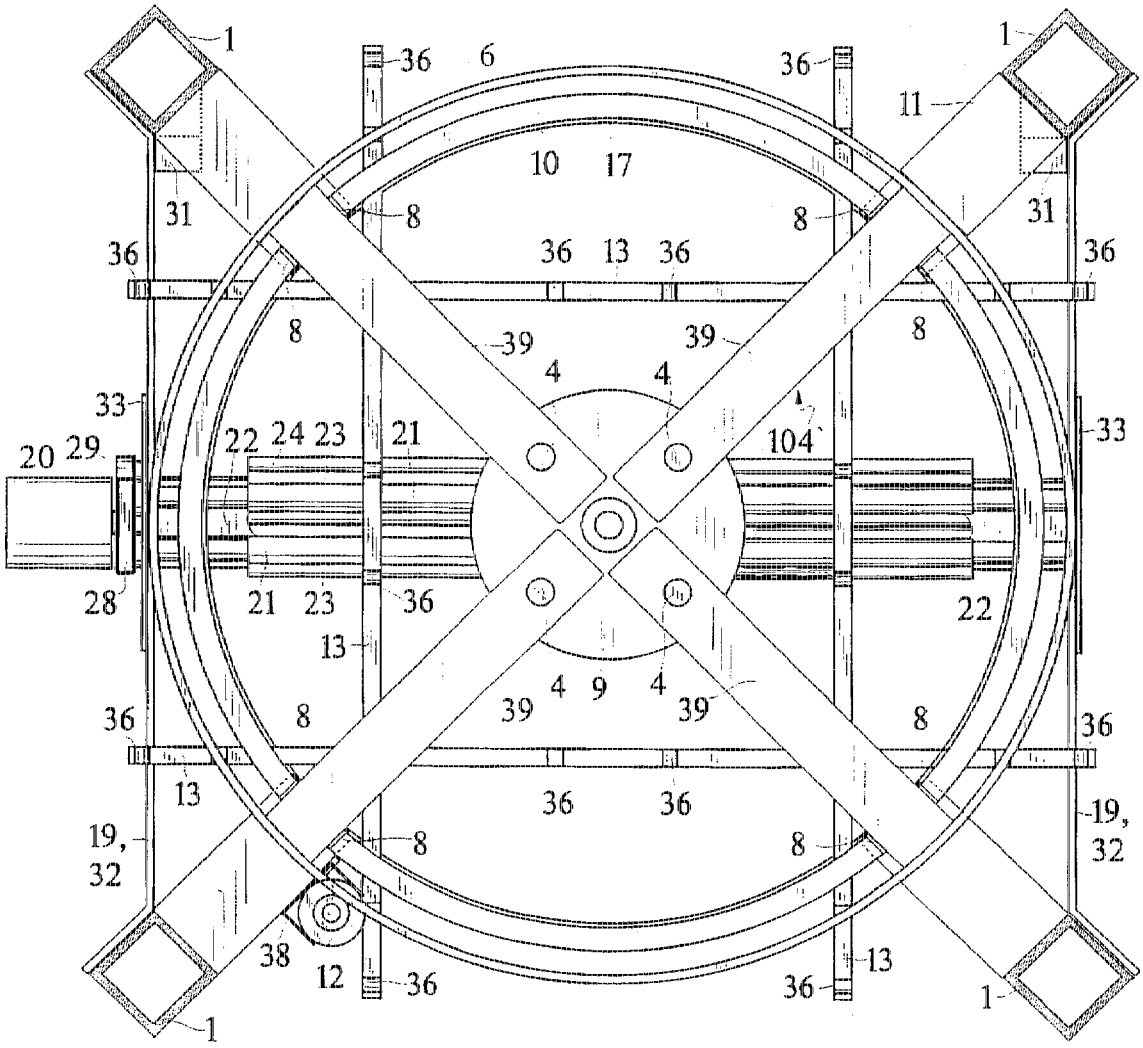
FIG. 4 is a sectional view taken according to the section line IV—IV in FIG. 1.

The cage 104 consists of four vertical legs 14 forming edges of a square-base parallelepiped, which suitably corresponds to one half of the base square area of the framework 100. The legs 14 occupy practically the entire vertical clearance between the top legs 2 above and the upper traverses 19 below. At their lower end the legs 14 are interconnected on their outer side by means of bars 18, and at their upper end they are interconnected by a top cross 104' (FIG. 4) fastened on top surfaces of the legs 14. The top cross 104' interconnects, similarly to the top cross 102, the legs 14 in diagonal directions of the respective square base. A hollow flanged shaft 9 (FIG. 8) is inserted from below in the middle of the top cross 104' and fastened thereto by means of a further set of screws 4, the shaft 9 protruding up through the cross 104' and being held in the top bearing 5.

Free ends of arms 39 of the top cross 104' radially project beyond the annular rail 10 and to their front surfaces a ring gear 6 is fastened. The outer diameter of the ring gear 6 suitably corresponds to the horizontal clearance between the bearing plates 33.

Figure 7A:
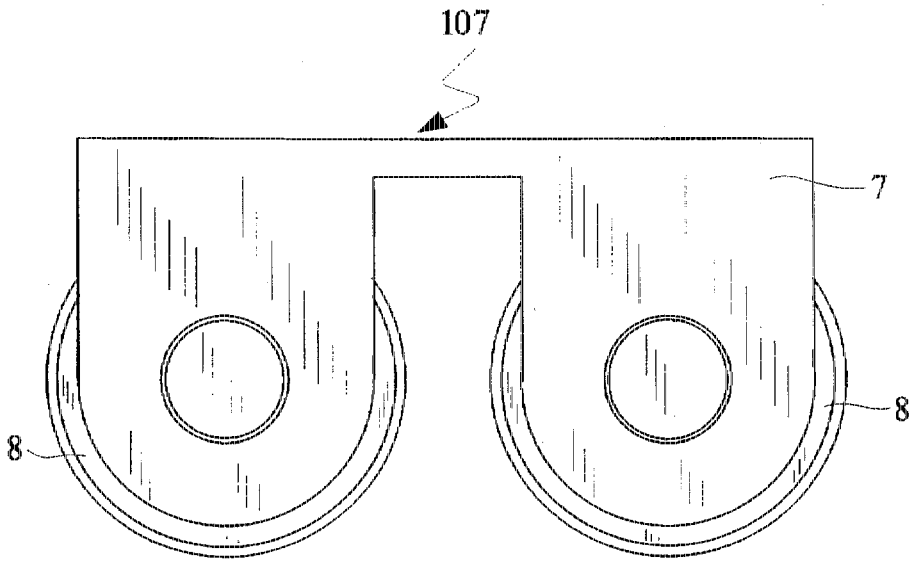
FIG. 7 shows a detail of the machine, namely a rolling assembly represented in an elevational view (a) and in plan view (b), respectively.
Figure 7B:
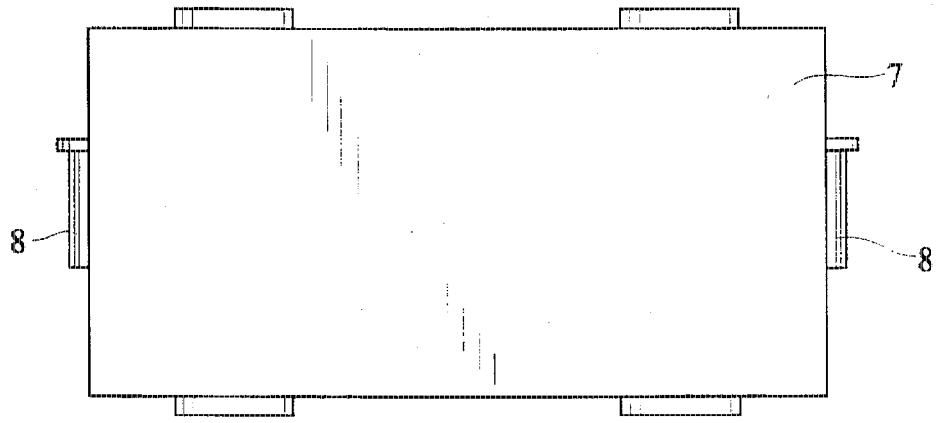

A rolling assembly 107 (FIG. 7) resting on the rail 10 is attached from below to each arm of the top cross 104'. The cage 104 together with all pertaining parts and the warp reels is, as an autonomous assembly, suspended from above on the rail 10.

The support 38 for an electromotor is fastened to a respective cantilever beam 11 and holds the electromotor 12, whose axis provides a pinion mating the ring gear 6.

In the cage region vertically between the ring gear 6 above and the interconnecting bars 18 below, to each pair of legs 14 (four legs create four pairs thereof) a horizontal truss 13 is fastened at the outer side of the legs, with two trusses 13 which reside at two opposite sides of the cage being arranged at a specific level and the other two trusses 13 which reside at the other two opposite sides of the cage being arranged at the other level.

To each pair of trusses 13, there belong two pairs of bearings 15 (one pair on each side of the cage) for suspending the shafts of the warp reels, the bearings 15 being fastened to the legs 14 in the planes which cross the trusses 13 belonging to the latter and spaced down from them. Totally, there are foreseen eight beatings for suspending four warp reels (one warp reel per cageside), with two opposite warp reels being positioned in one level and the remaining two warp reels being positioned in the other level.

According to the invention an individual drive for unrolling the warp reels is provided, which is similar to the prior art. To this end, each leg 14 of the cage provides a respective electromotor (not shown), whose arrangement and configuration depend on the design of warp drams (of prior art) for warp reels. The electromotors are energized by means of a rotary sliding contact (known per se) over cables introduced from outside through the hollow shaft 9.

Figure 6:
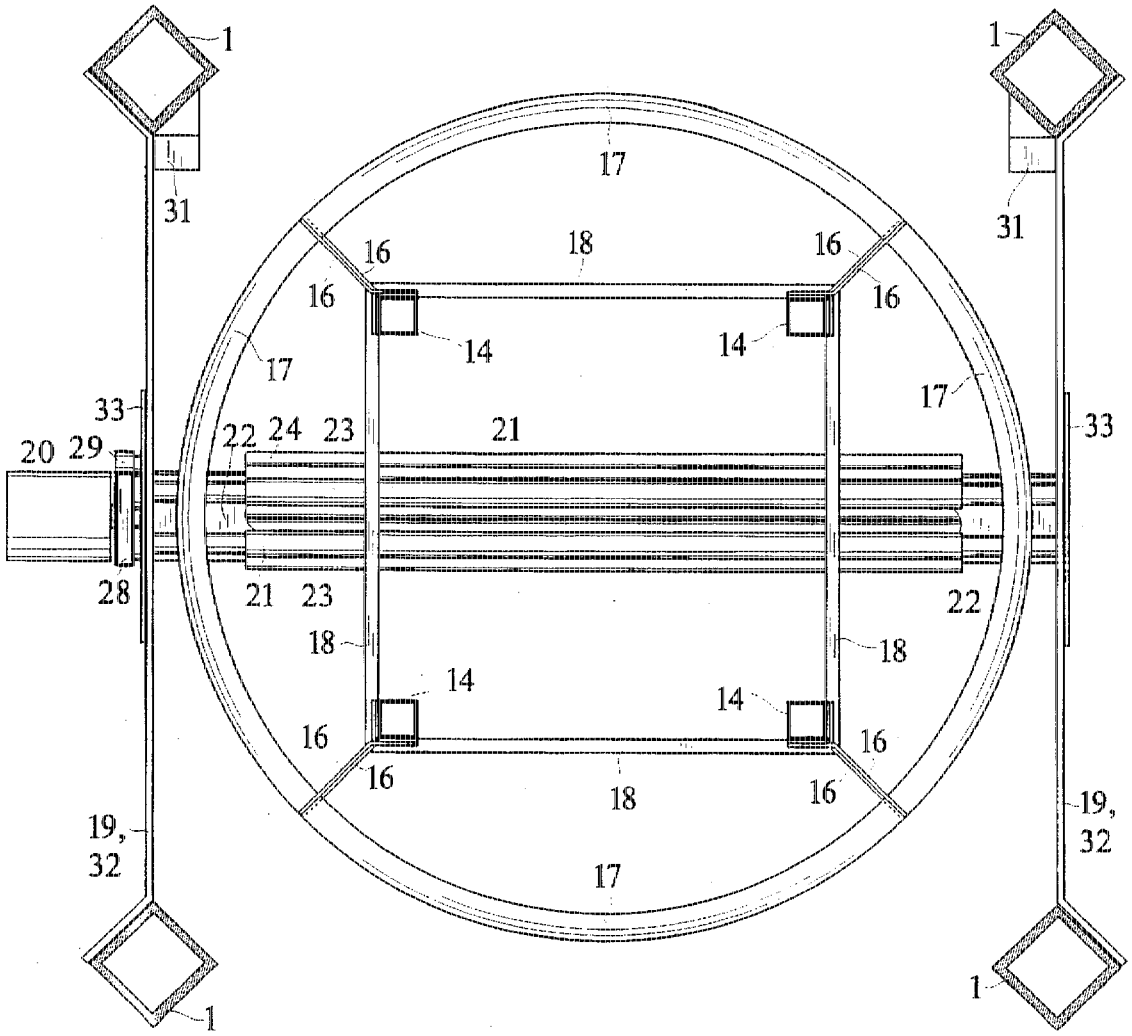
FIG. 6 is a sectional view taken according to the section line VI—VI in FIG. 1.
Figure 13:
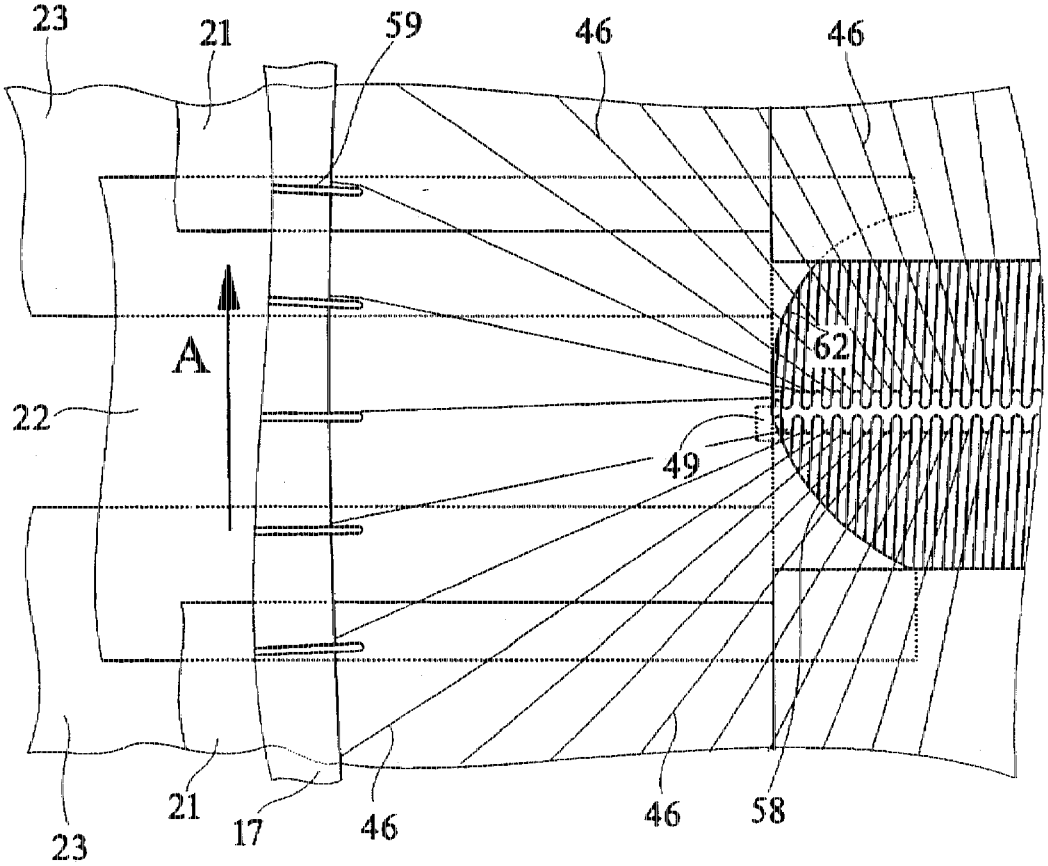
FIG. 13 is a sectional view of the machine taken along the line XIII—XIII in FIG. 1, showing a large-scale detail of the machine when operating.

In a vertical clearance between the lower pair of bearings 15 and the interconnecting bars 18 of the cage, four ribbed arcuate 90-grade circular-section rods 17 (see also FIG. 13) are fastened to the legs 14 by means of radial web girders 16 (FIG. 6), the rods 17 constituting a full ring with two opposite rods 17 positioned in a specific level and the remaining two opposite rods positioned in another level (similarly to the arrangement of the warp reels). Such a layout of rods makes it possible to obtain a spacing between a last yarn of a reel 43 and a first yarn of a neighbouring reel 43, which is equal to a common spacing between two neighbouring yarns of a respective reel. The rods 17 are designed to have disc-type annular ribs 59, which are suitably mutually equidistant.

The bearing plates 33 support a weaving assembly 108 incorporated there by quick assembling and disassembling, preferably requiring two steps—insertion and turning, and turning and removal, respectively. The following functions are realized in the weaving assembly 108:

the warp yarns previously arranged in the form of a circular funnel are rearranged to two vertical planar arrangements, the two arrangements residing closely to each other and comprising equal numbers of yarns;

two extreme positions of residing the border warp yarns are defined;

the yarns of a planar layout are reoriented to form a warp yarn Z-system and the yarns of another planar layout reoriented to form a warp yarn S-system;

a safe transfer of each border yarn from the warp yarn S/Z-system to the warp yarn Z/S-system is guaranteed;

sheds are formed and closed, respectively, and the warp is freely shifted in the direction of the weft at the shed forming place;

the weft is laid in at either the continuous or the stepwise rotation of the weft shaft;

the weft is beaten up to the woven fabric, and the warp is freely shifted in the direction of the weft at the weft laying-in place.

The weaving assembly 108 comprises, at the top, two mutually parallel, smooth, spaced intake rollers 21, which create a gap port (see also FIGS. 9 to 11 and 21 to 23, respectively). Below the intake rollers 21 two horizontally shaped lateral-shutters 22 are arranged, which are intended to define the weaving width, i.e. the position of the respective border yarns of the warp. Below the lateral shutters 22, a pair of mutually parallel spirally wound shafts 23 is positioned, which nearly touch each other and serve for shifting the warp yarns along the weft. Below one of the shafts a cam spindle 24, i.e. a spindle for forming/closing the shed is arranged, which is superposed with respect to a weft shaft 25, i.e. a shaft for laying in and beating up a weft yarn. Alternatively, below one of the said shafts a weft shaft 25', i.e. a spindle for forming/closing the shed, for laying in and beating up a weft yarn is arranged.

Figure 3:
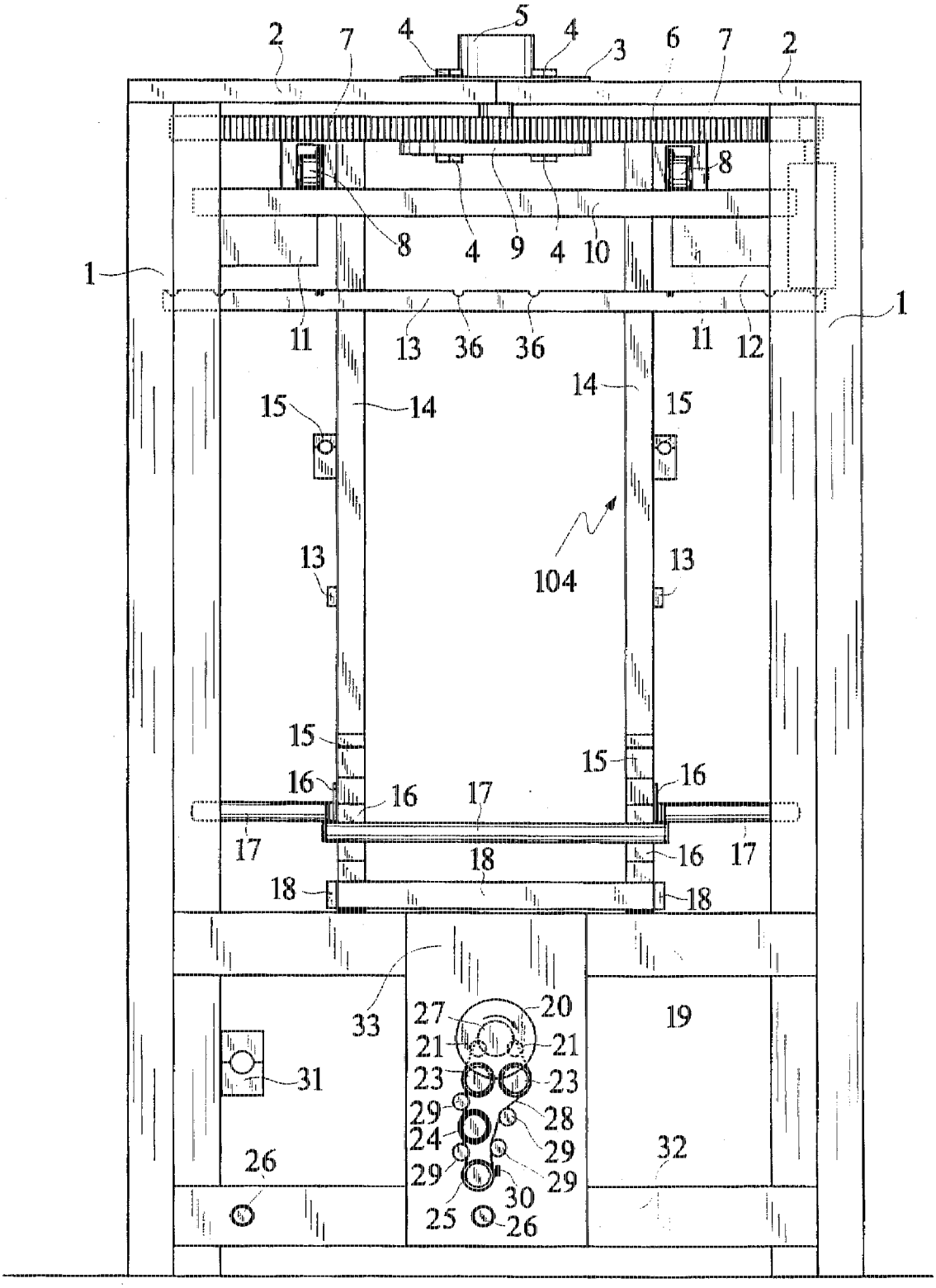
FIG. 3 is a side view of the machine as seen in the direction III in FIG. 1.

The weft shaft 25, the cam spindle 24 and the spirally wound shafts 23 are provided with toothed pulleys (FIG. 3), with a toothed belt 28 (alternatively a chain) being placed enveloping them as well as a toothed pulley 27 of the already mentioned electromotor 20. Along the runway of the belt 28, tension pulleys 29 are arranged at its back side.

Figure 19:
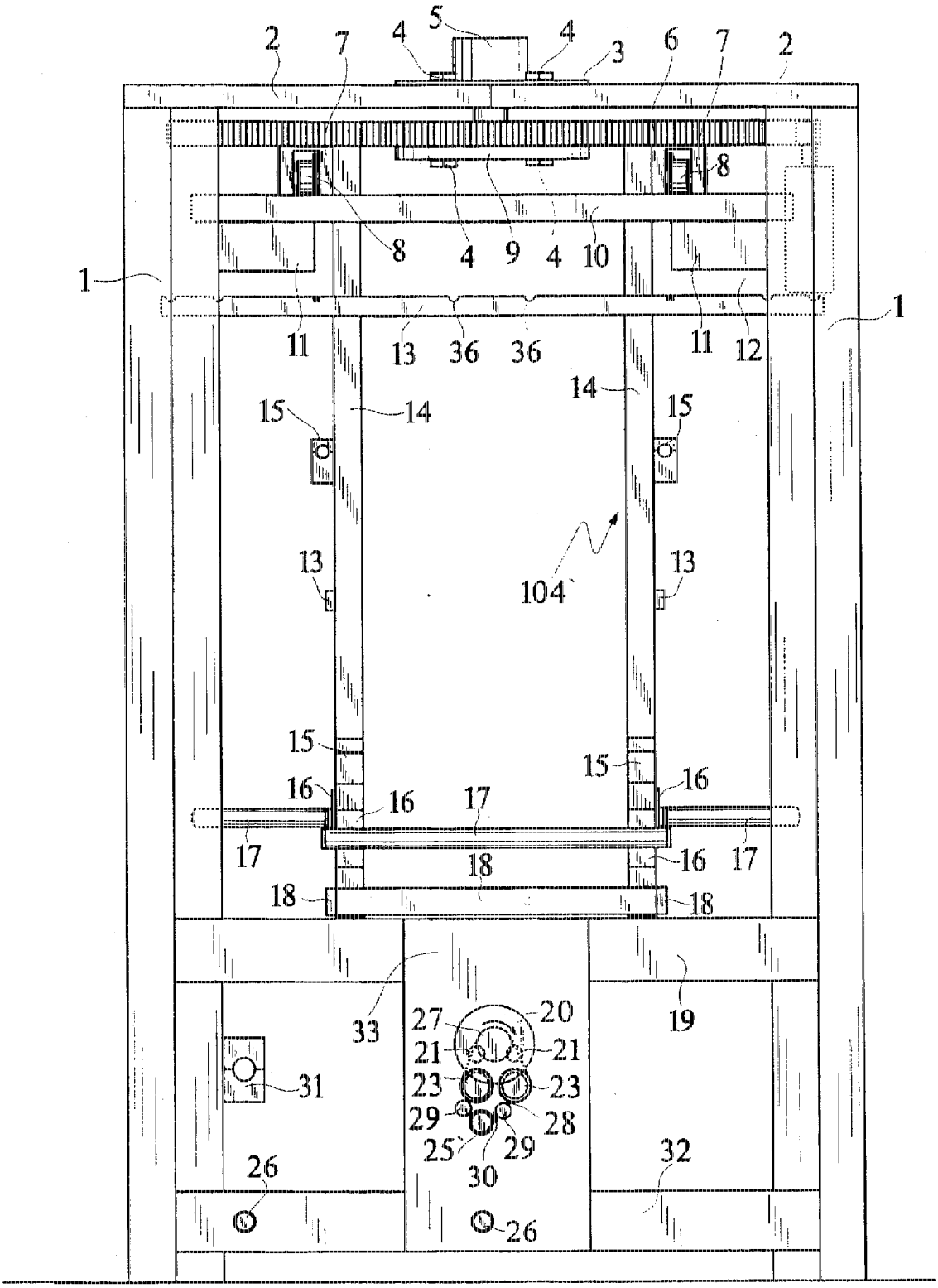
FIG. 19 is a side view of the machine as seen in the direction XIX in FIG. 18.
Figure 20:
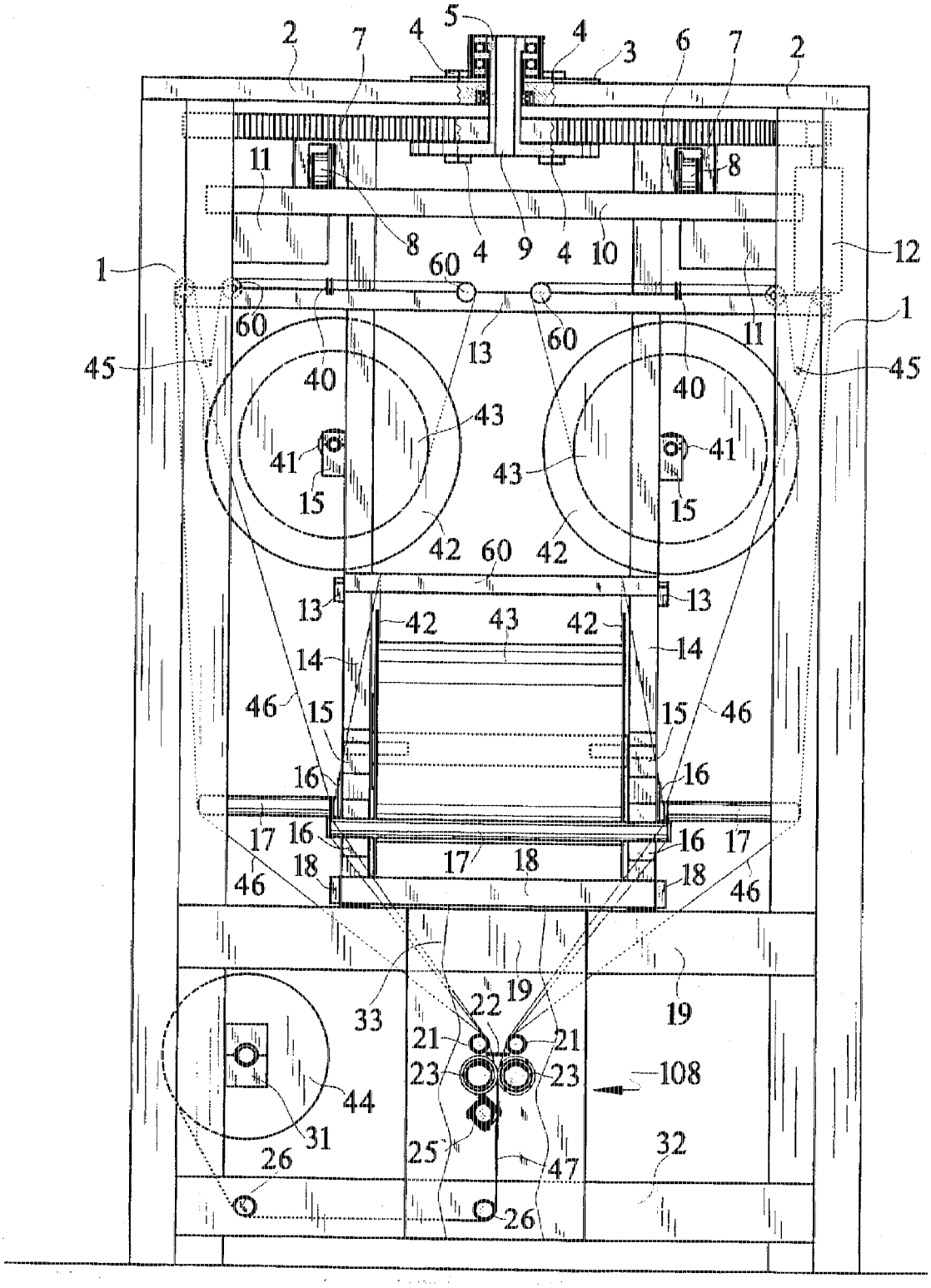
FIG. 20 is, similarly to FIG. 8, a side view of the machine according to FIG. 19 in operation, the upper-and the lower central parts of the machine being shown as a sectional elevation.
Figure 22:
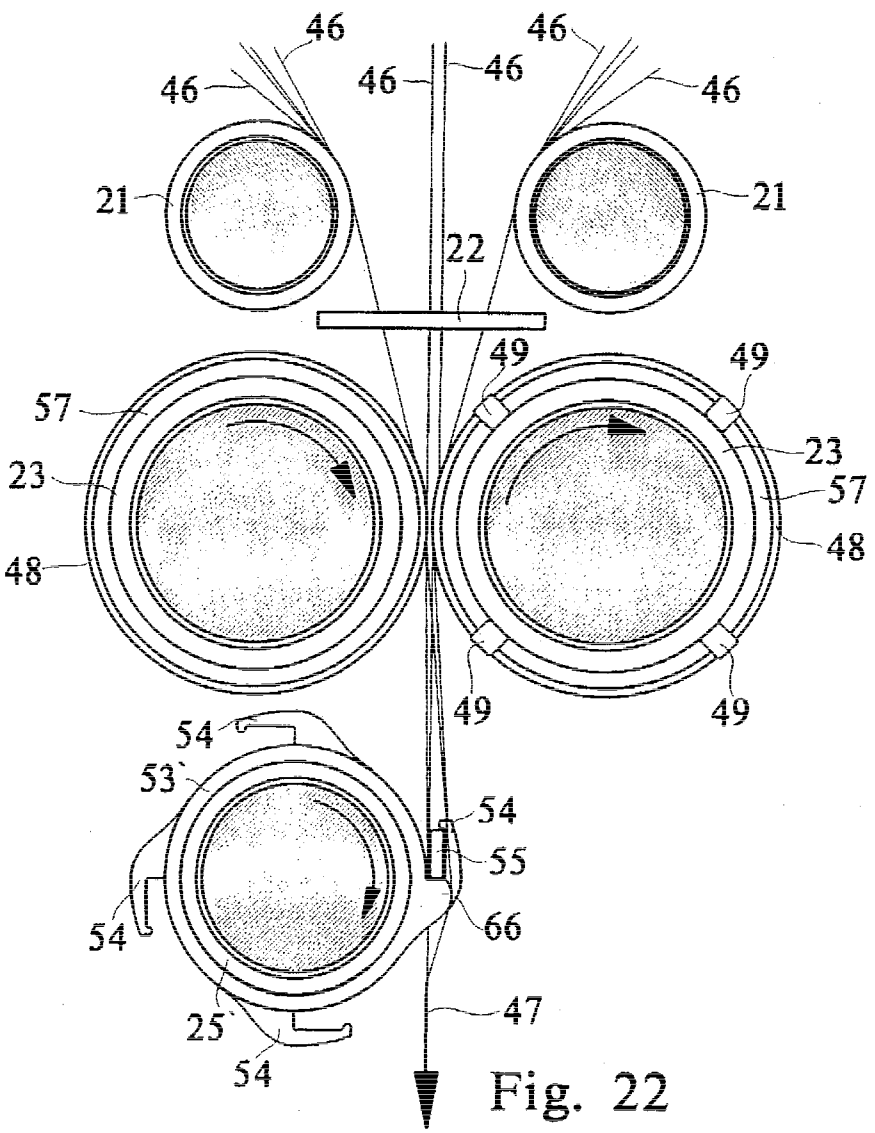
FIG. 22 is, similarly to FIG. 10, the weaving end of FIG. 21 in an open-shed state (with a weft being laid in)
Figure 21:
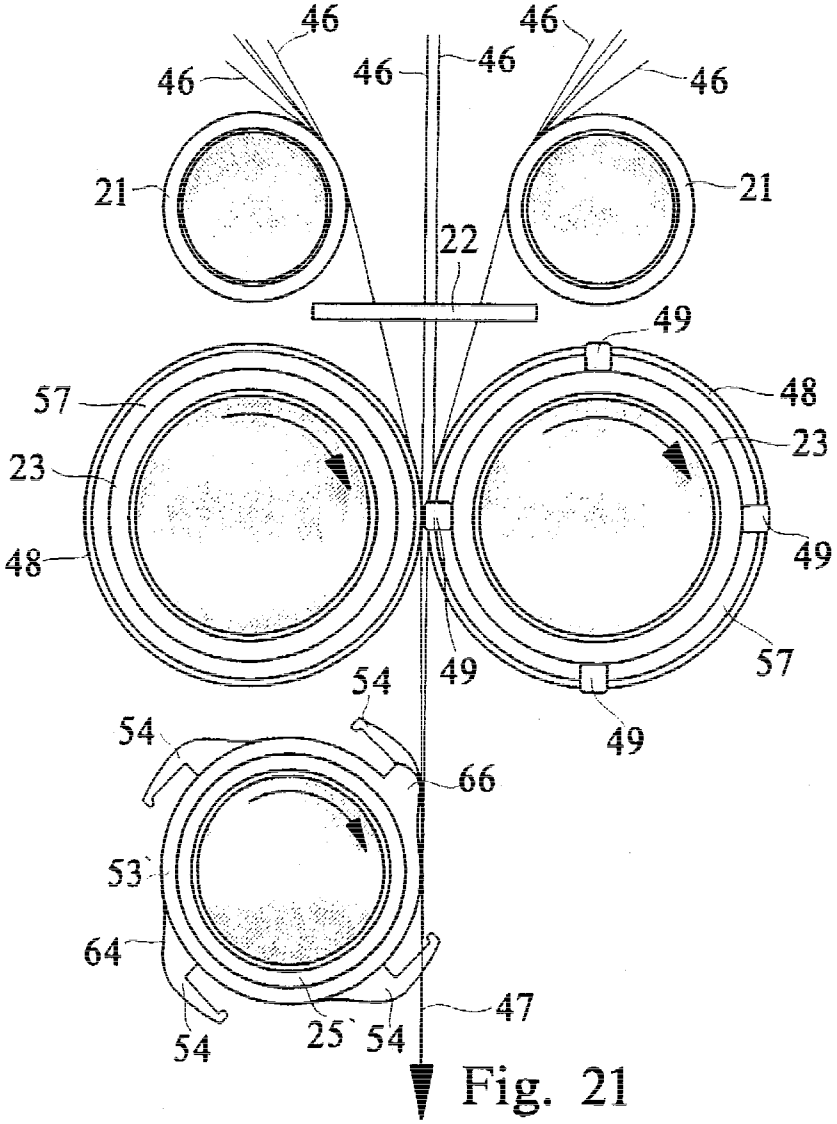
FIG. 21 shows, similarly to FIG. 9, a large-scale weaving end of the machine of FIG. 20, wherefrom there can be seen a shed-forming weft-laying-in and weft-beating-up assembly (the shed is closed), a superposed assembly for creating a warp-yarn Z-system and a warp-yarn S-system, respectively, and a superposed device for rearranging warp yarns from a preceding circular distribution to a subsequent planar two-plane distribution thereof.
Figure 23:
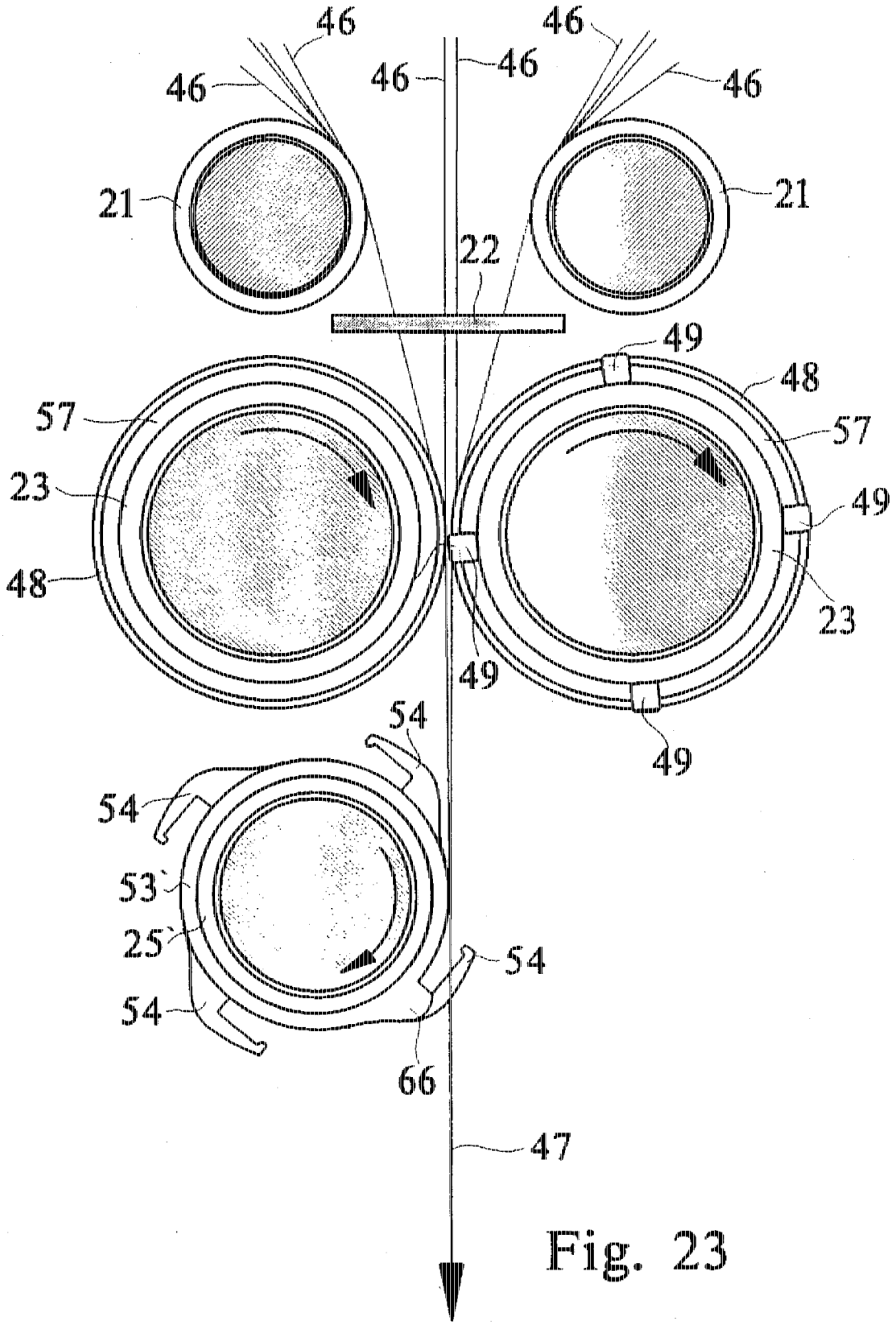
FIG. 23 is, similarly to FIG. 11, the weaving end of FIGS. 21 and 22 in a state prior to closing the shed (with a weft yarn being beaten up to the woven fabric)
Figure 25:
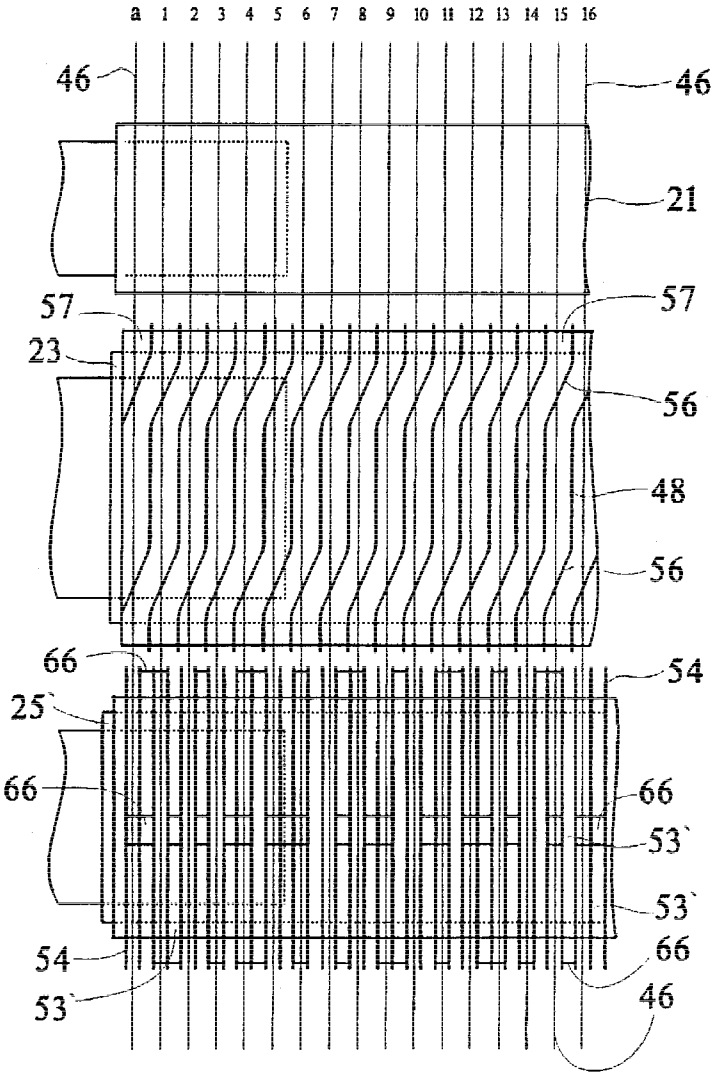
FIG. 25 is similar to FIG. 24 with an open shed.
Figure 24:
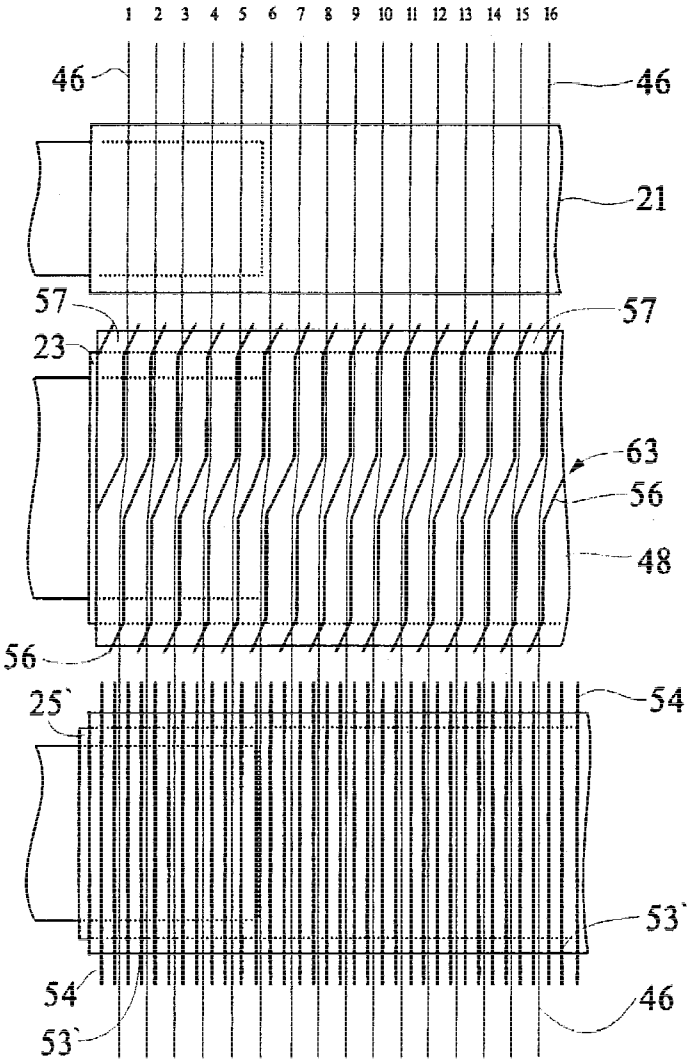
FIG. 24 is, similarly to FIG. 14, an elevational view of a part (an end part) of the weaving end of the machine of FIGS. 21 to 23 in the state of the shed being closed.
Figure 27:
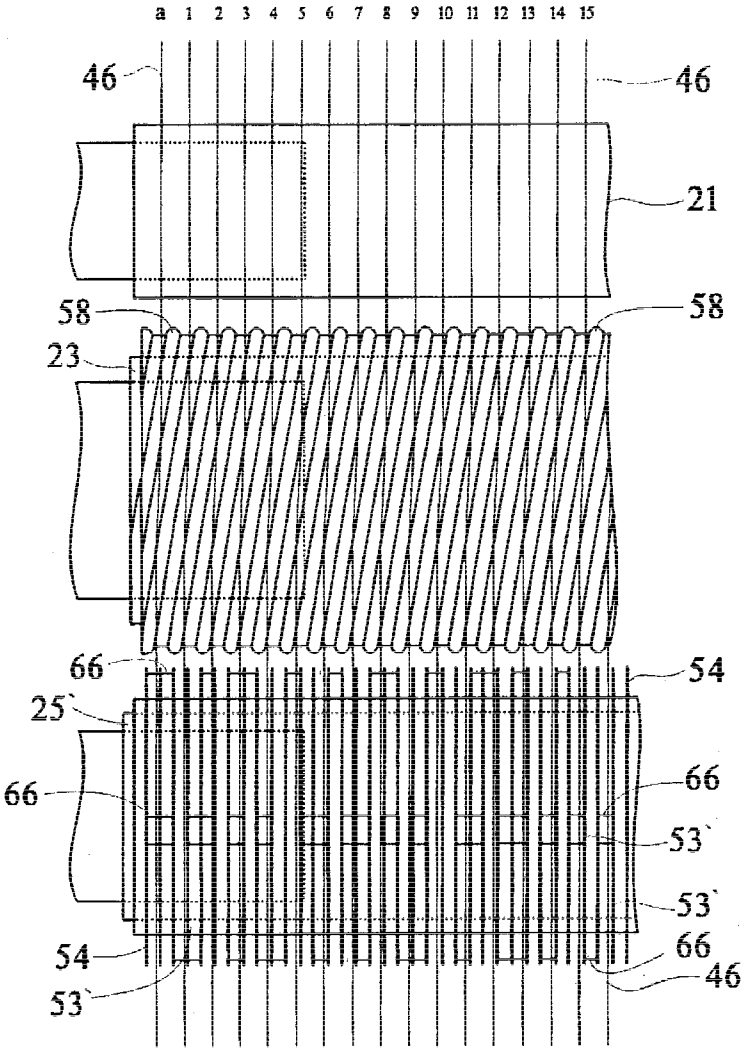
FIG. 27 is similar to FIG. 25, with the spirally wound shafts of FIG. 26 being used.
Figure 26:
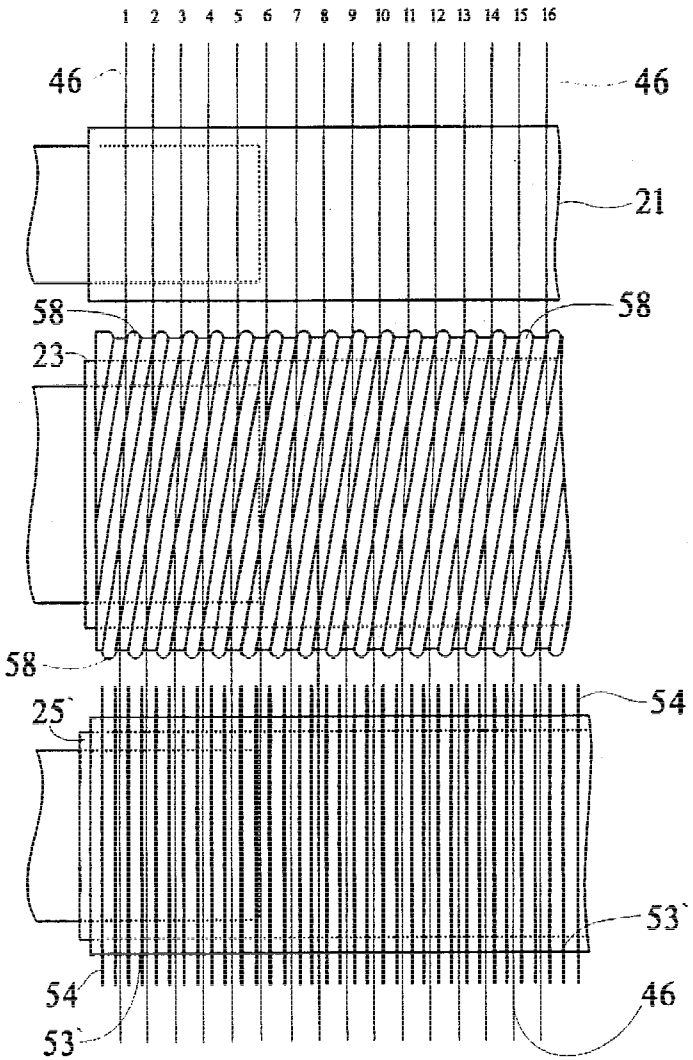
FIG. 26 is similar to FIG. 24, with respective spirally wound shafts being modified.

Alternatively, the weft shaft 25' and the spirally wound shafts 23 are provided with toothed pulleys (FIG. 19), with a toothed belt 28 (alternatively a chain) being placed enveloping them as well as a toothed pulley 27 of the already mentioned electromotor 20.

In the region of lower traverses 32, a first guiding roll 26 for woven fabric and parallel to it, below the bearings 31 of the cloth beam 44, a further guiding roll 26 for the woven fabric are incorporated.

The rolling assembly 107 (FIG. 7) consists of a holder 7 and of two flanged rollers 8 positioned in running direction one after another, whose axes are suitably oriented to the middle of the machine. Preferably, the flanges of the rollers 8 reside at the inner side of the rail 10.

Each horizontal truss 13 is designed to have three pairs of bearings 36 for supporting journal pins of guiding bars 60, i.e. suitably a pair at each end and a pair in the middle of the truss 13. Between the pair (each of two pairs) of bearings 36 arranged at the end of the truss and the one arranged in the middle thereof, each truss 13 is designed to have two bearings 61 for supporting two short-circuit (disconnecting) bars 40. As known in the respective technical field, appropriate control riders (one per warp yarn) are positioned over the disconnecting bars 40, the riders being supported by the yarns at a distance from the bars 40. If a yarn gets broken, the force to retain the rider at a distance over the bar 40 disappears; the rider drops onto the bar 40, it establishes a short circuit and hence an impulse to stop the machine.

At the end oriented to the inside of the machine the lateral shutters 22 is designed to have an arcuate recess 62 (FIG. 13) so that the intake rollers 21 and the lateral shutters 22 create, in plan, an essentially oblong hole to rearrange the distribution of warp yarns 46, which are slowly rotatably shifted (in the direction of arrow A in FIG. 13) together with the cage 104 from the preceding circular funnel-kind layout over the rollers 21 to a subsequent planar two-plane distribution thereof in the weaving assembly 108. In order to assist the transfer of each end yarn 46 from one shaft 23 to another one, the recess 62 is positioned nonconcentrically in the lateral shutters 22, which in turn is actually positioned concentrically in the machine, with the axis of symmetry of the recess 62 residing in the given case, in plan, in flush with a mantle generatrix of the roller 21, namely the one which receives the respective yarn.

Figure 14:
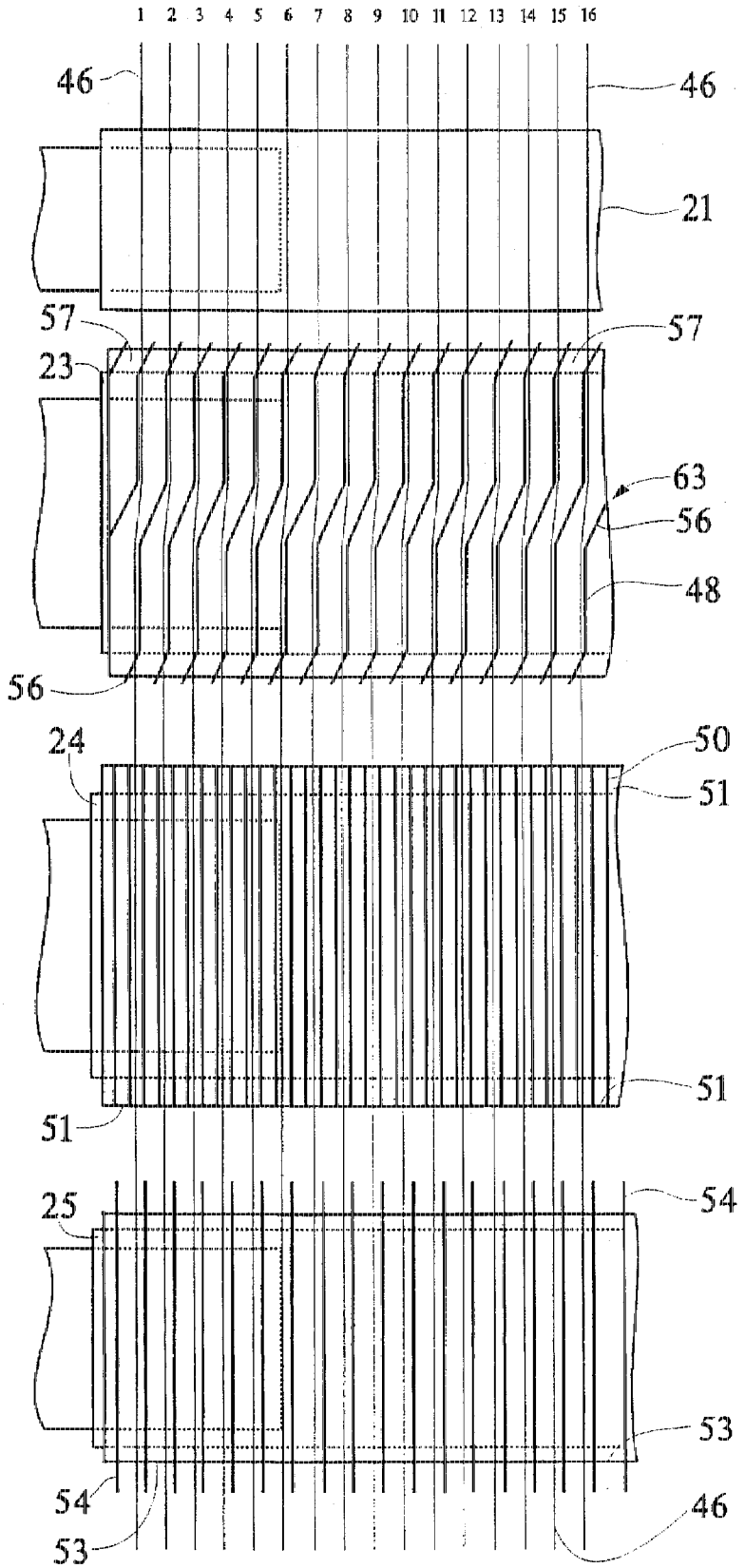
FIG. 14 is an elevational view of a part (an end part) of the weaving end of the machine of FIGS. 9 to 11 in the state the shed being closed.
Figure 15:
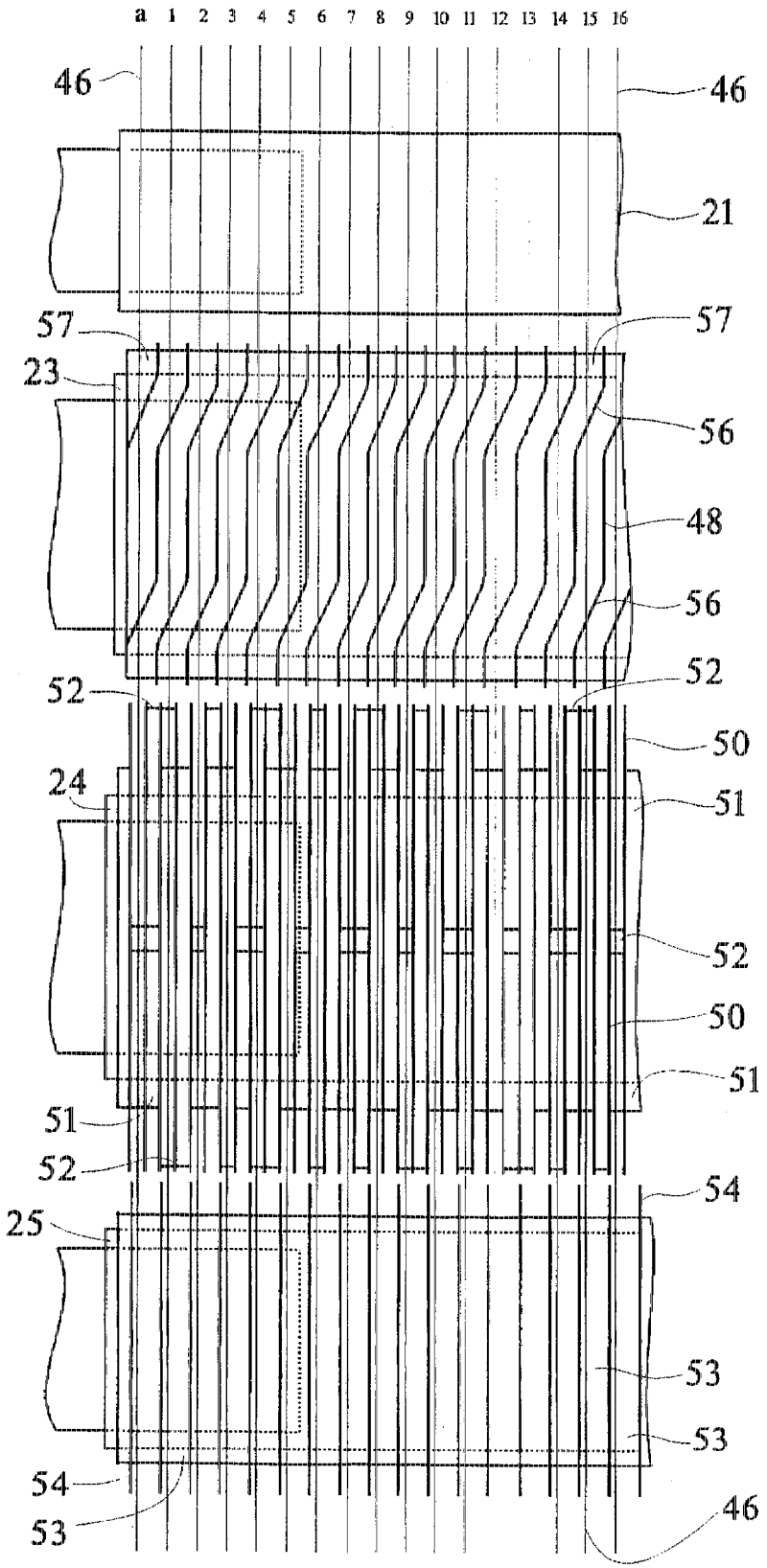
FIG. 15 is similar to FIG. 14 with an open shed.

The spirally wound shaft 23 of FIGS. 14 and 15 is constructed similarly to a four-thread screw, whose threads as such are essentially zigzag-shaped. In the given case the threads are constructed in the form of four lamellar ridges 63 (of negligible thickness) wound spirally along a cylindrical surface, the ridges being mutually parallel and creating uniform spiral grooves 57. In this embodiment, each ridge 63 is composed of regularly gauged length sections, which in this case are circumferential sections 48 and spiral (inclined) sections 56, respectively, which in assembled state form a zigzag-shaped spiral. All the circumferential sections 48 are equal to each other and positioned by their ends to reside in flush with a generatrix of the mantle of the cylinder, and all the inclined sections 56 are mutually equal and positioned by their ends to reside in flush with the (same) generatrix of the mantle of the cylinder. In the embodiment shown, which foresees rotation of the shafts 23 in the same direction (FIG. 9), the ridges 63 of a respective shaft 23 are left-handed and the ones of the other shaft 23 right-handed. At the exit side of the shaft 23, each ridge 63 terminates in a pusher 49 (for controlled shifting of a yarn being a last yarn 46 at a respective moment, from one shaft 23 to another one, the respective yarn representing there a new starting yarn), which is suitably designed to freely enter the working area of the neighbouring shaft 23 when rotating.

The mantle configuration of the shaft 23 of FIGS. 14 and 15 is practically composed of ridges 63 as separate components and of spacers arranged therebetween, the components and spacers being positionally correctly fixed on the body of the shaft 23.

Figure 16:
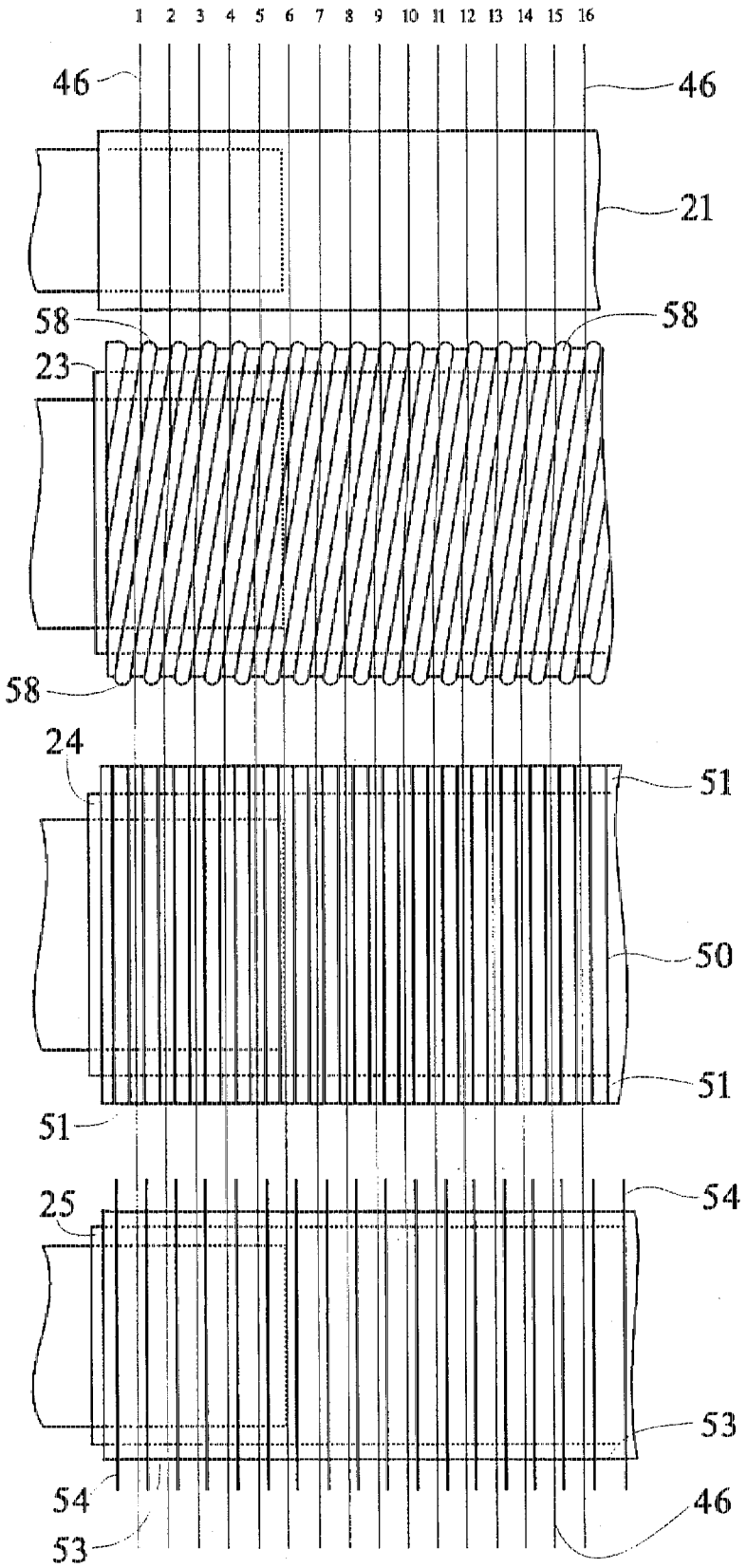
FIG. 16 is similar to FIG. 14, with respective spirally wound shafts being modified.
Figure 17:
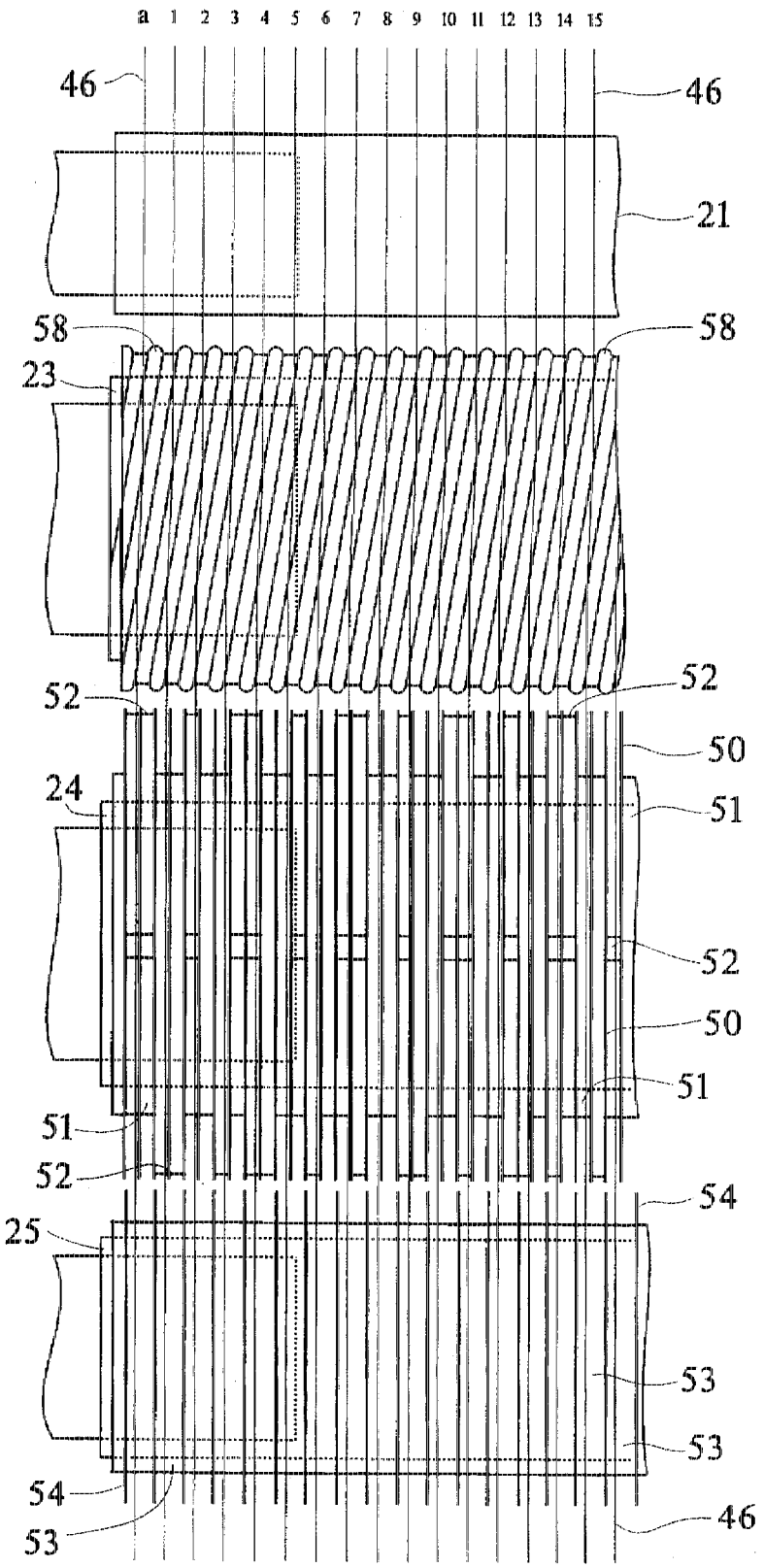
FIG. 17 is similar to FIG. 15, with the spirally wound shafts of FIG. 16 being used.
Figure 18:
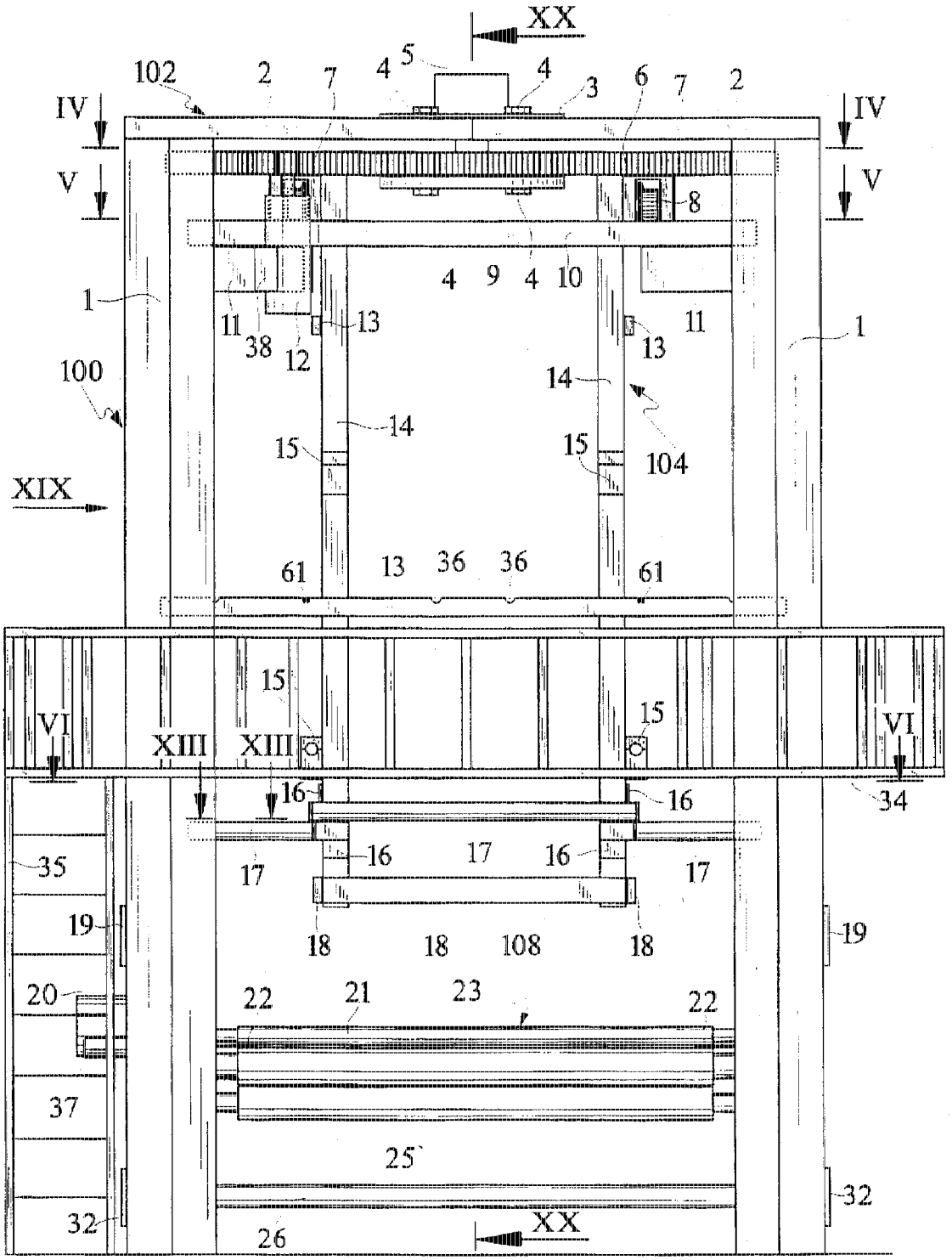
FIG. 18 is, similarly to FIG. 1, an elevational view of the front side of an alternative machine prepared to apply warp reels and to arrange the warp, with the actually existing weft laying-in attachments being omitted from the drawing.

FIGS. 16 and 17 show a modified embodiment of the shaft 23, whose ridges 58 are smooth (continuous) spirals.

The cam spindle 24 provides a mantle configuration composed of a plurality of radially emphasized annular discs 50 (of a negligible thickness) and a plurality of radially emphasized annular cam-shaped spacers 51, the discs and the spacers being arranged alternatingly, with the density of the discs and spacers corresponding to two spacers 51 per spiral groove 57 of the shaft 23. The peripheral contour of the discs 50 is square with rounded corners (FIGS. 9 to 11), the discs being incorporated to form an assembly so that their rounded corners reside in flush with the generatrices of the spindle. The spacers 51 in turn are basically circular elements, whose outer diameter equals the sides of the square of the discs 50, and have one or more cams 52 being formed integrally with them, whose outer contour prevailingly corresponds to that of the discs 50; merely at the tip of the cam, the latter is shortened to an extent required to guide a yarn between the discs 50. The number of the cams 52 at individual spacers 51 as well as the circumferential position (orientation) thereof in an assembled spindle 24 depend on the intended kind of the triaxial woven fabric. In the weaving assembly 108, the cam spindle 24 is arranged so that when the shed is closed (FIG. 9), the discs 50 butt against the warp, with the side of the disc 50 being parallel to the warp.

The proposed cam spindle 24 makes it possible to create weaves providing four wefts in its repeat of pattern, i.e. it can create sixteen different weaves. According to the teachings of the invention, a cam spindle can also be foreseen for e.g. six wefts, which results in sixty-four different weaves so that, as to the weaves, all customers' demands can be met.

The weft shaft 25, too, provides a mantle configuration composed of a plurality of radially emphasized annular discs 64 (of a negligible thickness) and a plurality of annular spacers 53, the discs and the spacers being arranged alternatingly. The graduation of the configuration corresponds to that of the spirally wound shaft 23. All discs 64, on the one hand, and all spacers 53, on the other hand, are equal to each other.

The disc 64 consists of a ring (no reference numeral) which, observed in axial direction, registers with the spacer 53, and of formed prongs 54—four in the given embodiment. The prong 54 comprises three main sections (no separate reference numerals): a radial section connected to the basic ring of the disc, a tangential section connected, by one of its ends, to the radial section, and a further radial section formed integrally with the other end of the tangential section and oriented to the axis of the disc. The three sections of the prong 54 arranged in the above-mentioned manner create a cavity 65. The bottom of one respective cavity 65 and the bottom of an opposite cavity 65 reside in the same plane, which is the diametral plane of the weft shaft. The tangential section of the prong 54 is oriented contrary to the rotation of the weft shaft 25. The spacers 53 are simple rings.

Alternatively, the weft shaft 25' provides a mantle configuration composed of a plurality of radially emphasized annular discs 64 (of a negligible thickness) and a plurality of cam spacers 53', the discs and the spacers being arranged alternatingly. The graduation of the configuration corresponds to that of the spirally wound shaft 23. All discs 64, on the one hand, and all spacers 53', on the other hand, are equal to each other. The disc 64 consists of a basic ring (no reference numeral) which, observed in radial direction, registers with the basic ring of the spacer 53', and of formed prongs 54—four in the given embodiment. The prong 54 comprises three main sections (no separate reference numerals): a radial section connected to the basic ring of the disc, a tangential section connected, by one of its ends, to the radial section, and a further radial section formed integrally with the other end of the tangential section and oriented to the axis of the disc. The three sections of the prong 54 arranged in the above-mentioned manner create a cavity 65. The bottom of one respective cavity 65 and the bottom of an opposite cavity 65 reside in the same plane, which is the diametral plane of the weft shaft. The tangential section of the prong 54 is oriented contrary to the rotation of the weft shaft 25'.

The cam spacer 53' each consists of a basic ring (no reference numeral) and a radial cam 66. The cam is designed to provide a straight rear edge flushing with the bottom of the cavity 65.

The invention makes it possible to lay in wefts irrespective of whether the machine operates continuously or discontinuously. If the machine works continuously, the weft is laid in by air/water jet techniques or by projectile-type devices, if discontinuously, then other techniques can be applied as well. At the first approach, the travelling of a weft carrier is synchronized with the rotation of the cam spindle 24 and the weft shaft 25, i.e. the cams 52 are arranged forming a spiral along the cam spindle 24 and a channel (for the travelling of the weft carrier) formed by the cavities 65 is coiled forming an analogous helix; at the other approach the cams 52 reside in flush with a generatrix of the cam spindle 24 and the channel of the weft shaft 25 is straight and in flush with the mantle generatrix of the weft shaft 25. Alternatively, at the first approach, the travelling of a weft carrier is synchronized with the rotation of the weft shaft 25', i.e. the cams 66 are arranged forming a spiral along the weft shaft 25' and a channel (for the travelling of the weft carrier) formed by the cavities 65 is coiled forming an analogous helix; at the other approach the cams 66 reside in flush with a generatrix of the weft shaft 25'. The channel of the weft shaft 25' is then straight and in flush with the mantle generatrix of the weft shaft 25'.

In each bearing plate 33 a recess 30 (FIG. 3) is provided, which corresponds to the cavity 65 and is located in registry with cavities 65 of a respective longitudinal series of prongs 54 when the bottom of cavities 65 lies in a horizontal plane. At the other side of bearing plates 33 a device (not shown) known per se for placing a weft carrier 55 (FIG. 10) is arranged at this position.

Figure 12A:
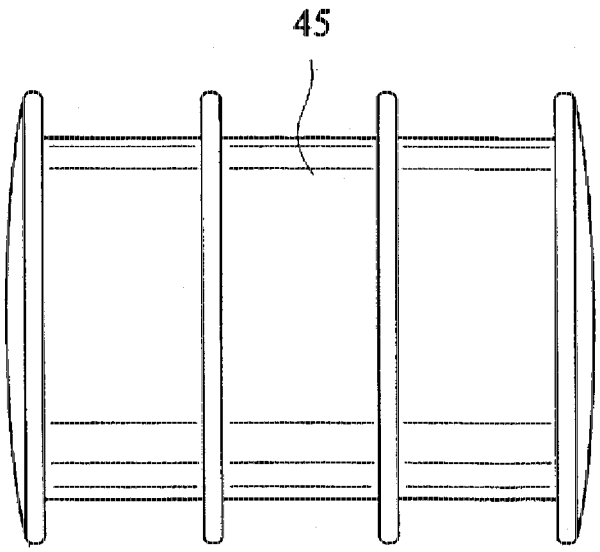
FIG. 12 is an elevational view (a) and a side view (b) of a burdening roller (rider weight) for automatic compensation of the length of warp yarns.
Figure 12B:
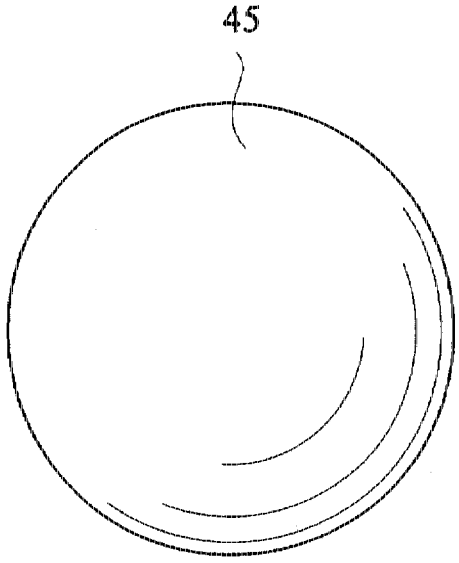

To the machine also burdening rollers (rider weights) 45 (FIG. 12) belong, which as such are loose parts that can be lost. In the proposed embodiment the roller 45 provides two intermediate circumferential ribs (partitions) in addition to the end ribs so that the working length of the roller is divided into three sections. The ends of the roller 45 are spherical. The rollers 45 thus touch each other substantially spotwise without interfering with each other when tilting, rising and lowering individually in the course of the operation of the machine.

Figure 8:
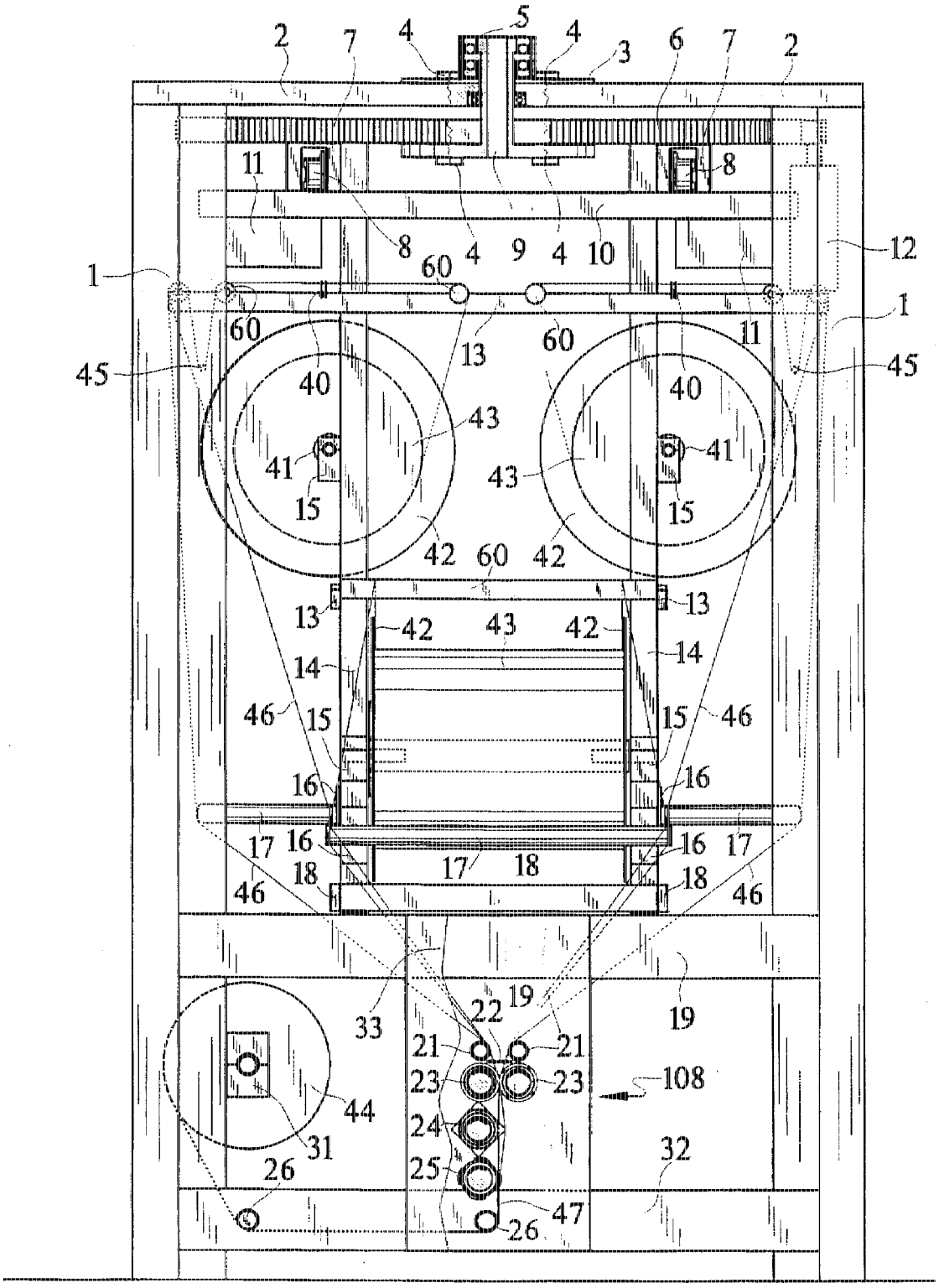
FIG. 8 is a side view of the machine according to FIG. 3 in operation, the upper and the lower central parts of the machine being shown as a sectional elevation.

The machine is designed to apply four warp reels 43 (FIG. 8). The yarns of each warp reel 43 are wound onto a warp shaft 41, which in turn is inserted in respective bearings 15 and connected torque-transferringly with an unwinding motor (not shown). Reels 42 carrying the warp reels 43 are placed so that, initially, free ends of yarns are suspended at the radially outer side thereof.

The yarns 46 of a respective reel 43 (and, analogously, yarns of each reel) are arranged to run at the radially inner side of the reel upwards to the nearest central guiding bar 60 placed on tresses 13, whereupon they are deflected to run horizontally over the short-circuit (disconnecting) bars 40 up the end pair of guiding bars 60. Thus warp yarns run radially outwards up the outer border of the machine (a similarity to the machines for manufacturing biaxial woven fabrics). From the outermost guiding bar 60 the yarn is laid to run by its own reel 43 at the outer side down to a respective ribbed arcuate rod 17 (to each reel 43 one such rod 17 belongs) and therefrom it runs further down over a respective smooth intake roller 21 (one of two rollers 21 receives yarns of two reels i.e. one half of all yarns, the other one in turn receives the other half of yarns), then over a respective spirally wound shaft 23 (here, too, one of the two shafts receives the yarns of two reels and the other one in turn receives yarns of the remaining two reels), then by the cam spindle 24 and the weft shaft 25 (alternatively: then by the weft shaft 25') up a first fabric-guiding roll 26, where it alters the orientation and runs to another fabric-guiding roll 26, where a further reorientation thereof occurs prior to being led to the cloth beam 44 supported by the bearings 31, with the yarns finally being tied on said cloth beam. The yarns 46 set as explained above form a warp, which is not tense yet. In a subsequent step the yarns 46 are stretched by placing the burdening rollers 45 in the space between the outer guiding bars 60. Each burdening roller 45 is foreseen to stretch a plurality of yarns. The yarns 46 so stretched are disposed equidistantly on the ribbed arcuate rods 17, then controlled by the spiral grooves 57 of the shafts 23 and laid between the discs 50 of the cam spindle 24 and the discs 64 of the weft shaft 25. The final step of laying the warp is to put the control riders onto the yarns over the short-circuit (disconnecting) bars 40.

The unwinding propelling of reels 43, the rotation of the respective pans of the weaving assembly 108 and of the cloth beam 44 mutually correspond to each other. The unwinding electromotor of a respective warp reel switches on when the tension of the warp exceeds a predetermined value. Alternatively, the advance at unwinding the warp is constant and each weft is followed by a warp unwinding step.

The spirally wound shafts 23 hold the tense warp yarns in their spiral grooves 57. At their rotation the warp yarns 46 move transversely along them, with the yarns belonging to one of them moving in one direction (Z warp) and those belonging to the other one moving in another direction (S warp). As soon as a yarn is shifted to an end of the shaft 23, the respective pusher 49 departs and pushes it to the port of a just released groove of the neighbouring shaft 23. Thus, each yarn when reaching the end of the shaft (one yarn at one end of each shaft per 90° of the rotation of shafts 23) changes the system of yarns (from Z to S and from S to Z, respectively).

The mantle configuration of the cam spindle 24 is assembled for forming a shed according to a predetermined weave pattern. Within the period of the shed being closed (FIG. 9), the warp yarns are shifted to either direction along the weft so that a respective yarn of the S/Z system in each subsequent step of forming the sheds resides at a location which is progressed for one pitch along the shaft 24 in comparison with its previous location.

Figure 9:
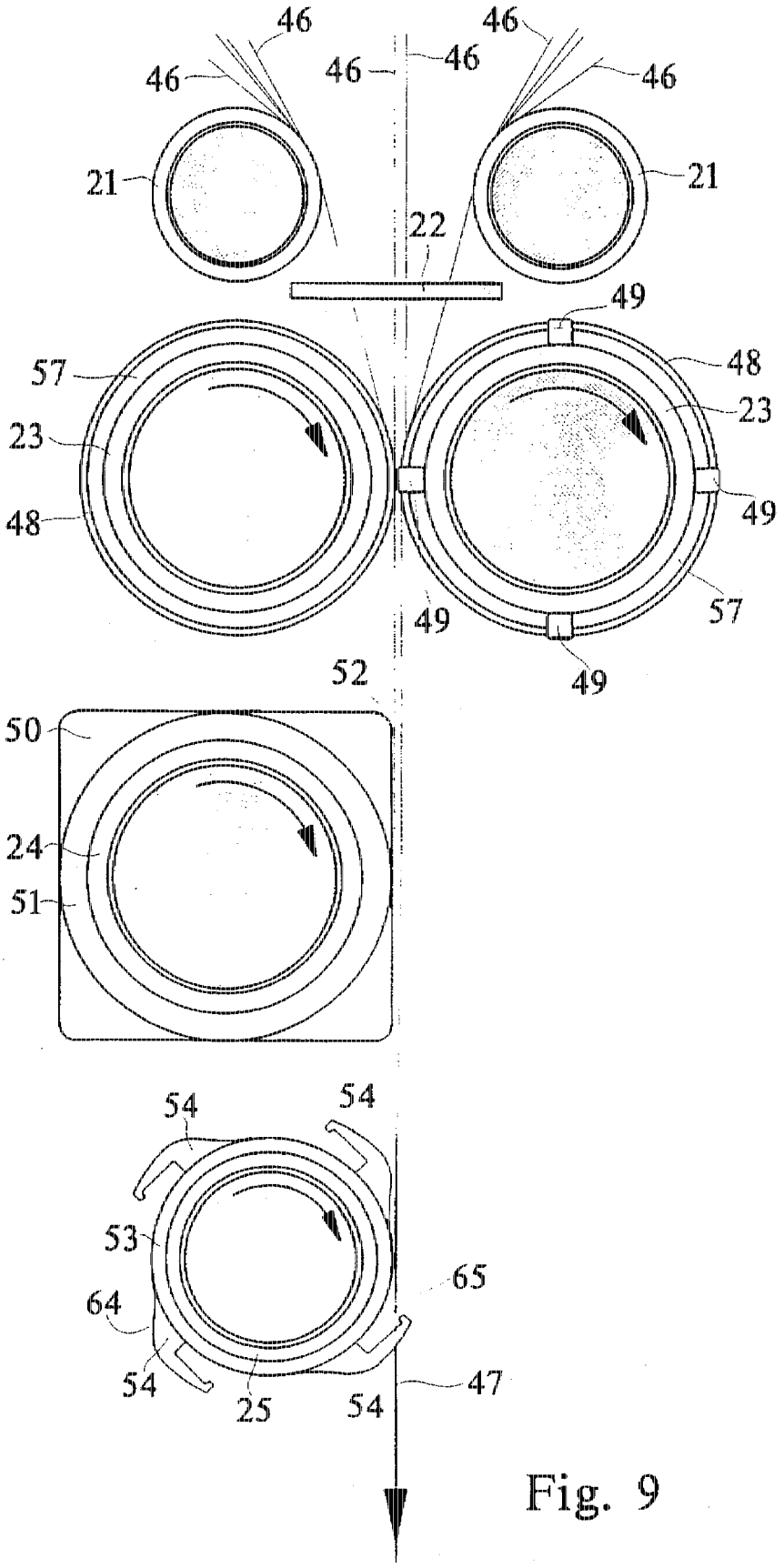
FIG. 9 shows a large-scale weaving end of the machine of FIG. 8, wherefrom there can be seen a weft laying-in and weft beating-up attachment, a superposed shed-forming assembly (the shed is closed), a superposed assembly for creating a warp-yarn Z-system and a warp-yarn S-system, respectively, and a superposed device for rearranging warp yarns from a preceding circular distribution to a subsequent planar two-plane distribution thereof.
Figure 10:
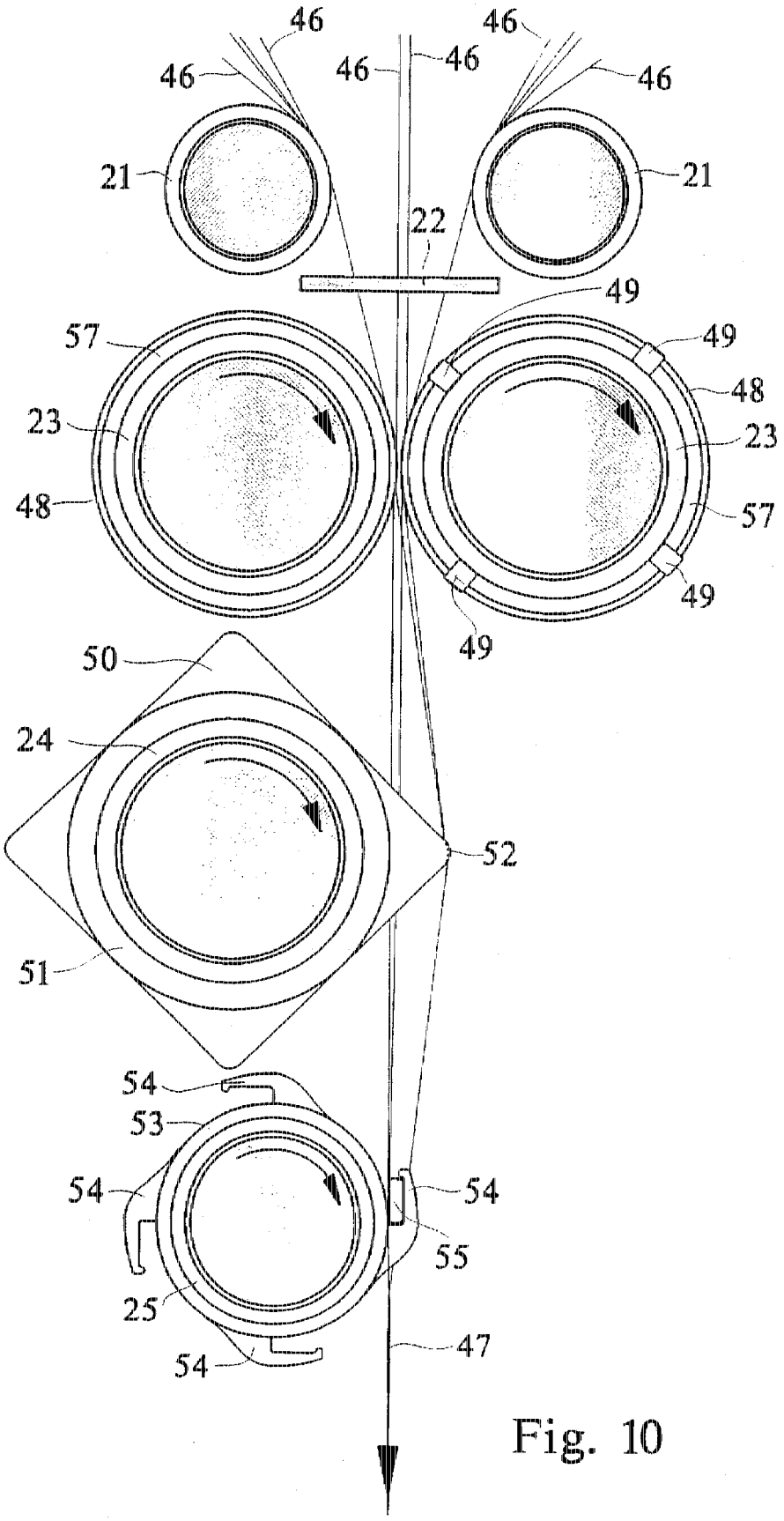
FIG. 10 is the weaving end of FIG. 9 in an open-shed state (with a weft being laid in)
Figure 11:
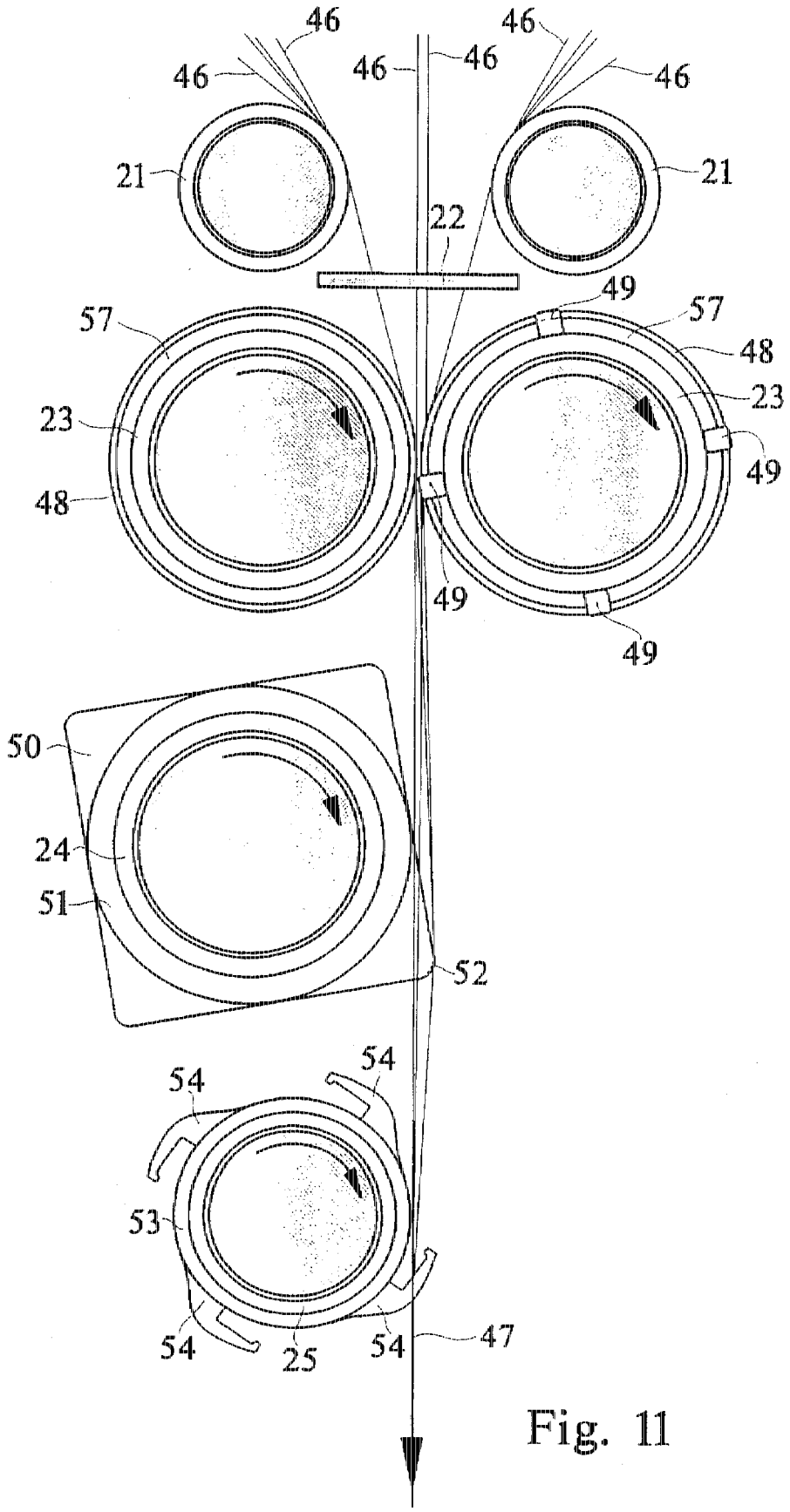
FIG. 11 is the weaving end of FIGS. 9 and 10 in a state prior to closing the shed (with a weft yarn being beaten up to the woven fabric)

The weft shaft 25 (alternatively: the weft shaft 25') of the invention also serves as a loom batten, here a rotational one. Here, too, the warp yarns are shifted to either direction along the weft after the weft was laid in and the shed was closed (FIG. 9). Simultaneously, the prongs 54 beat up (by their back edges) the weft just laid in to a woven fabric 47.

Thus the machine provides no oscillating parts, so that the working capacity of the machine of the invention can be significantly increased in comparison with that of known machines. Since the forming of the warp proceeds from inside outwards, which is similar to techniques with machines for manufacturing biaxial woven fabrics, and since the weaving preparation as such is essentially equal to that for biaxial woven fabrics, the incorporation of machines for manufacturing triaxial woven fabrics in a weaving room for manufacturing biaxial woven fabrics does not require any extra training of the workers nor any additional investments in the weaving preparation. The warp yarns are easily accessible on a prevailing length thereof; if a yarn breaks, it can be simply and quickly incorporated into the woven fabric by means of an auxiliary thread. The aim of the invention has thus been achieved.

I claim:

1. Triaxial weaving machine comprising an upright framing which supports a rotary cage for applying warp reels and for driving said warp reels to unroll their yarns and for compensating for length differences between lengths of warp yarns, a stationary device positioned underneath said rotary cage for rearranging the warp yarns from a preceding circular distribution to a subsequent planar two-plane distribution thereof, an assembly positioned underneath said rotary cage for creating a warp-yarn Z-system and a warp-yarn S-system, respectively, a shed-forming assembly and a weft laying-in and beating-up, respectively, attachment positioned underneath said rotary cage, and a section of the machine to accommodate a triaxially woven fabric, the rotary cage including warp reels arranged in two levels;

the stationary device positioned underneath said rotary cage for rearranging the warp yarns including two intake rollers and two lateral shutters arranged below said wrap reels for defining a weaving width;

the assembly positioned underneath said rotary cage for creating the warp-yarn Z-system and the warp-yarn S-system including two spirally wound shafts for shifting the warp yarns along the weft;

the shed-forming assembly including a cam spindle for forming/closing the shed, said cam spindle being incorporated under a respective spirally wound shaft; and the weft laying-in and beating-up, respectively, attachment including a weft shaft for laying in and beating up a weft yarn.

2. Triaxial weaving machine according to claim 1, wherein either level of warp reels in the rotary cage includes, a pair of trusses which traverse the respective two warp reels and support guiding bars, three per spool, and disconnecting bars, two per reel, with warp yarns from each warp spool led at an inner side of the machine upwards around an inner one of said support guiding bars and are then reoriented to an outer side of the machine and led over said two disconnecting bars and a middle one of said support guiding bars and, finally, around an outer one of said support guiding bars downwards by an outer side of the respective reel.

3. Triaxial weaving machine according to claim 1, wherein below a lower one of said two warp reel levels, the cage provides four 90-grade ribbed arcuate rods, one per each reel, with two opposing rods of said four rods positioned in a horizontal plane and the other two opposing rods positioned in another horizontal plane, with warp yarns being led downwards by an outer mantle surface of the arcuate rods.

4. Triaxial weaving machine according to claim 1, wherein the spirally wound shaft shifts warp yarns of the warp-yarn Z-system and the warp-yarn S-system, respectively, along a path of the weft and includes four ridges, with each of said four ridges terminating, at an end where a warp yarn leaves the warp-yarn Z/S-system and enters the warp-yarn S/Z-system, by a pusher to assist the transfer of the yarns from one warp-yarn system to the other one.

5. Triaxial weaving machine according to claim 4, wherein the ridges are zigzag-shaped and each include four circumferential sections and four inclined sections.

6. Triaxial weaving machine according to claim 4, wherein the ridges are each a smooth continuous helix.

7. Triaxial weaving machine according to claim 1, wherein the cam spindle includes a plurality of radially emphasized annular discs and a plurality of radially emphasized annular cam-shaped spacers, said discs and said spacers being arranged alternatingly, with a thickness of the discs being negligibly small and a peripheral contour of the discs being square with rounded corners, said discs being incorporated to form an assembly so that they are uniformly oriented with their rounded corners lying flush with generatrices of the cam spindle, whereas said spacers are circular elements and at least one cam is formed integrally with said spacers, each at least one cam is oriented to a respective corner of the square of the discs.

8. Triaxial weaving machine according to claim 1, wherein the weft shaft includes a plurality of radially emphasized annular discs and a plurality of annular spacers, the discs and the spacers are arranged alternatingly, with a thickness of said discs being negligibly small and the discs each being an annular element, whose outer diameter equals that of the spacers, and comprising prongs which each include three sections, namely a radial section connected to a basic ring of the disc, a tangential section connected, by one of its ends, to said radial section, and a further radial section formed integrally with another end of said tangential section and oriented with respect to an axis of the disc, so that the three sections of the prong create a cavity, whose bottom resides in a plane of the weft shaft, which includes an axis of the weft shaft.

9. Triaxial weaving machine according to claim 8, wherein an outer edge of the tangential section of the prong is used for beating up the weft in a woven fabric.

10. Triaxial weaving machine comprising an upright framing supports a rotary cage for applying warp reels and for driving said warp reels to unroll their yarns and for compensating for length differences between lengths of warp yarns, a stationary device positioned underneath said rotary cage for rearranging the warp yarns from a preceding circular distribution to a subsequent planar two-plane distribution thereof, an assembly positioned underneath said rotary cage for creating a warp-yarn Z-system and a warp-yarn S-system, respectively, a shed-forming weft laying-in and weft-beating-up, respectively, weft shaft positioned underneath said rotary cage, and a section of the machine to accommodate a triaxially woven fabric, the rotary cage including said warp reels arranged in two levels;

the stationary device positioned underneath said rotary cage for rearranging the warp yarns including two intake rollers and two lateral shutters arranged below said warp reels for defining a weaving width;

the assembly positioned underneath said rotary cage for creating the warp-yarn Z-system and the warp-yarn S-system including two spirally wound shafts for shifting the warp yarns along the weft; and that the shed-forming weft-laying-in and weft-beating-up, respectively, weft shaft for laying in and beating up a weft yarn being incorporated under a respective spirally wound shaft.

11. Triaxial weaving machine according to claim 10, wherein either level of warp reels in the rotary cage includes a pair of trusses which traverse the respective two warp reels and support guiding bars, three per spool, and disconnecting bars, two per spool, with warp yarns from each warp spool led at an inner side of the machine upwards around an inner one of said support guiding bars and are then reoriented to an outer side of the machine and led over said two disconnecting bars and a middle bar one of said support guiding bars and, finally, around an outer one of said support guiding bars downwards by an outer side of the respective reel.

12. Triaxial weaving machine according to claim 10, wherein below a lower one of said two warp reel levels, the cage provides four 90-grade ribbed arcuate rods, one per each reel, with two opposing rods of said four rods positioned in a horizontal plane and the other two opposing rods positioned in another horizontal plane, with warp yarns being led downwards by an outer mantle surface of the arcuate rods.

13. Triaxial weaving machine according to claim 10, wherein the spirally wound shaft shifts warp yarns of the warp-yarn Z-system and the warp-yarn S-system, respectively, along a path of the weft and includes four ridges, with each of said four ridges terminating, at an end where a warp yarn leaves the warp-yarn Z/S-system and enters the warp-yarn S/Z-system, by a pusher to assist the transfer of the yarns from one warp-yarn system to the other one.

14. Triaxial weaving machine according to claim 13, wherein the ridges are zigzag-shaped and each include four circumferential sections and four inclined sections.

15. Triaxial weaving machine according to claim 13, wherein the ridges are each a smooth continuous helix.

16. Triaxial weaving machine according to claim 10, wherein the weft shaft includes a plurality of radially emphasized annular discs and a plurality of cam spacers, the discs and the spacers being arranged alternatingly, with a thickness of said discs being negligibly small and the discs each being an annular element, whose outer diameter equals that of a ring of the spacers, and comprising prongs which each include three sections, namely a radial section connected to a basic ring of the disc, a tangential section connected, by one of its ends, to said radial section, and a further radial section formed integrally with another end of said tangential section and oriented with respect to an axis of the disc, so that the three sections of the prong create a cavity, whose bottom resides in a plane of the weft shaft, which includes an axis of the weft shaft.

17. Triaxial weaving machine according to claim 16, wherein a cam provides a straight rear edge lying flush with the bottom of the cavity.

18. Triaxial weaving machine according to claim 10, wherein an outer edge of the tangential section of the prong is used for beating up the weft in a woven fabric.

* * * * *